US008969224B2

(12) United States Patent
Masuda et al.

(10) Patent No.: US 8,969,224 B2
(45) Date of Patent: Mar. 3, 2015

(54) SEA-ISLAND COMPOSITE FIBER, ULTRAFINE FIBER, AND COMPOSITE SPINNERET

(75) Inventors: Masato Masuda, Mishima (JP); Akira Kishiro, Mishima (JP); Joji Funakoshi, Otsu (JP); Yoshitsugu Funatsu, Mishima (JP); Seiji Mizukami, Otsu (JP)

(73) Assignee: Toray Industries, Inc. (JP)

( * ) Notice: Subject to any disclaimer, the term of this patent is extended or adjusted under 35 U.S.C. 154(b) by 122 days.

(21) Appl. No.: 13/521,752

(22) PCT Filed: Jan. 26, 2011

(86) PCT No.: PCT/JP2011/051482

§ 371 (c)(1), (2), (4) Date: Jul. 12, 2012

(87) PCT Pub. No.: WO2011/093331

PCT Pub. Date: Aug. 4, 2011

(65) Prior Publication Data

US 2012/0288703 A1 Nov. 15, 2012

(30) Foreign Application Priority Data

Jan. 29, 2010 (JP) ..... 2010-018728
Sep. 10, 2010 (JP) ..... 2010-202992

(51) Int. Cl.
*D04H 1/00* (2006.01)
*D04H 3/00* (2012.01)
(Continued)

(52) U.S. Cl.
CPC .. *D01D 4/06* (2013.01); *D01D 5/30* (2013.01); *D01D 5/36* (2013.01); *D01F 8/04* (2013.01); *D01D 5/253* (2013.01)
USPC ..... 442/340; 442/347; 442/351; 442/363

(58) Field of Classification Search
CPC ..... D01D 4/06; D01D 5/30; D01D 5/36; D01D 5/253; D01F 8/04
USPC ..... 442/340, 347, 351, 363
See application file for complete search history.

(56) References Cited

U.S. PATENT DOCUMENTS 5,736,083 A * 4/1998 Dugan ..... 264/103
5,965,084 A * 10/1999 Nishijima ..... 264/557
(Continued)

FOREIGN PATENT DOCUMENTS

JP 54-131019 A 10/1979
JP 2-145812 A 6/1990
(Continued)

OTHER PUBLICATIONS

Japanese Official Action dated Jun. 23, 2014 from corresponding Japanese Application No. 2011-015617.
(Continued)

*Primary Examiner* — Jeremy R Pierce
(74) *Attorney, Agent, or Firm* — DLA Piper LLP (US)

(57) ABSTRACT

A sea-island composite fiber has an island component which is ultrafine fibers having a noncircular cross-section, the ultrafine fibers being uniform in the degree of non-circularity and in the diameter of the circumscribed circle. The sea-island composite fiber includes an easily soluble polymer as the sea component and a sparingly soluble polymer as the island component, and the island component has a circumscribed-circle diameter of 10-1,000 nm, a dispersion in circumscribed-circle diameter of 1-20%, a degree of non-circularity of 1.2-5.0, and a dispersion in the degree of non-circularity of 1-10%.

4 Claims, 7 Drawing Sheets

(51) Int. Cl.

| | |
|---|---|
| ***D04H 13/00*** | (2006.01) |
| ***D04H 5/00*** | (2012.01) |
| ***D01D 4/06*** | (2006.01) |
| ***D01D 5/30*** | (2006.01) |
| ***D01D 5/36*** | (2006.01) |
| ***D01F 8/04*** | (2006.01) |
| ***D01D 5/253*** | (2006.01) |

(56) References Cited

U.S. PATENT DOCUMENTS

| | | | | |
|---|---|---|---|---|
| 2001/0055683 | A1* | 12/2001 | Ochi et al. | 428/373 |
| 2003/0039832 | A1* | 2/2003 | Tsutsui et al. | 428/373 |
| 2006/0057350 | A1* | 3/2006 | Ochi et al. | 428/292.1 |
| 2009/0042029 | A1* | 2/2009 | Havel et al. | 428/372 |
| 2010/0007042 | A1* | 1/2010 | Simmonds | 264/172.13 |

FOREIGN PATENT DOCUMENTS

| | | | |
|---|---|---|---|
| JP | 02-293403 | | 12/1990 |
| JP | 07-026420 | | 1/1995 |
| JP | 8-158144 | A | 6/1996 |
| JP | 2001-123331 | A | 5/2001 |
| JP | 2001-192924 | A | 7/2001 |
| JP | 2001-279546 | | 10/2001 |
| JP | 2006-183153 | | 7/2006 |
| JP | 2007-039858 | A | 2/2007 |
| JP | 2007-100243 | A | 4/2007 |
| JP | 2007-169829 | | 7/2007 |
| JP | 2007-247118 | | 9/2007 |
| JP | 2008-242047 | A | 10/2008 |
| WO | 89/02938 | A1 | 4/1989 |

OTHER PUBLICATIONS

Japanese Official Action dated Jul. 7, 2014 from corresponding Japanese Application No. 2010-202992.

* cited by examiner

17

SEA-ISLAND COMPOSITE FIBER, ULTRAFINE FIBER, AND COMPOSITE SPINNERET

RELATED APPLICATIONS

This is a §371 of International Application No. PCT/JP2011/051482, with an international filing date of Jan. 26, 2011 (WO 2011/093331 A1, published Aug. 4, 2011), which is based on Japanese Patent Application Nos. 2010-018728, filed Jan. 29, 2010, and 2010-202992, filed Sep. 10, 2010, the subject matter of which is incorporated by reference.

TECHNICAL FIELD

This disclosure relates to a sea-island composite fiber, and ultrafine fibers produced from said sea-island composite fiber, which are noncircular in cross sectional form and are excellent in uniformity.

BACKGROUND

Fibers made of thermoplastic polymers such as polyesters and polyamides are excellent in mechanical properties and dimensional stability, and therefore are widely used not only for clothing applications, but also for home interior, car interior and industrial applications and the like, having very high industrial values. However, at present when applications of fibers are diversified, the properties required of fibers are diverse, and the existing polymers may not be able to respond to those required properties in some cases. If novel polymers that can respond to those applications are designed at the level of molecules, the problems of cost and time are a problem. Consequently the development of composite fibers having the properties of multiple polymers may be selected as the case may be. In these composite fibers, for example, a main component is covered with another component, to provide sensitive effects such as hand and bulkiness or mechanical properties such as strength, initial modulus and abrasion resistance which cannot be achieved by fibers of a single component only. Composite fibers come in a variety of forms and modes, and various techniques have been proposed for adaptation to respective applications of fibers. Among those composite fibers, active R&D is conducted on so-called "sea-island" composite fibers in each of which numerous island component fibers are disposed in a sea component.

A typical application of sea-island composite fibers is the production of ultrafine fibers. In this case, a slightly soluble island component is disposed in a soluble sea component, and from the obtained fiber or textile product with this configuration, the soluble component is removed to leave island component fibers as ultrafine fibers. In this case, extremely ultrafine fibers of the nano-order that cannot be produced by any single spinning technique can also be obtained. Ultrafine fibers with a single fiber fineness of hundreds of nanometers can be developed, for example, as artificial leathers and textiles exhibiting new feelings and senses by using the soft touch and delicateness unavailable from general fibers. In addition, the compact inter-fiber gaps are used to provide high-density woven fabrics usable as sports clothing requiring wind-breaking capability and water-repelling capability. The ultrafine fibers go into fine grooves and provide large specific surface areas, and the very fine inter-fiber voids can catch dirt. Therefore, ultrafine fibers exhibit high adsorbability and dust collectability. These properties are used for industrial material applications as wiping cloths and precision polishing cloths for precision apparatuses, etc.

The sea-island composite fibers as a starting material of ultrafine fibers include two major types. One is the polymer alloy type in which polymers are melt-kneaded together, and the other is the composite spinning type using a composite spinneret. Among these composite fibers, the composite spinning type is considered to be an excellent technique since the composite cross section can be precisely controlled by using a spinneret.

Techniques concerning the sea-island composite fibers of the composite spinning type include, for example, the techniques characterized by composite spinnerets disclosed in JP 8-158144 A and JP 2007-39858 A.

In JP '858, a soluble component polymer reservoir extended in the cross sectional direction is installed below the holes of a slightly soluble component, and the slightly soluble component is inserted into the soluble component polymer reservoir to produce sheath-core composite streams, the sheath-core composite streams then being joined and subsequently compressed, to be discharged from the final hole. In that technique, for both the slightly soluble component and the soluble component, the passage widths established between a diversion passage and introduction holes are used to control the pressures, to make the inserting pressures uniform, thereby controlling the amounts of the polymers discharged from the introduction holes. Making the pressures uniform of the respective introduction holes like this is excellent in view of controlling polymer streams. However, to keep the size of the final island component fibers on the nano-order, at least the polymer amount of each introduction hole at least on the sea component side is as very small as $10^{-2}$ to $10^{-3}$ g/min/hole, and therefore the pressure loss proportional to the polymer flow rate and the wall interval becomes almost 0. This makes it very difficult to control the polymers as the sea component and the island component precisely. In fact, the ultrafine fibers obtained from the sea-island composite fibers obtained in examples was approx. 0.07 to approx. 0.08 d (approx. 2700 nm), and ultrafine fibers of the nano-order were not obtained.

JP '858 indicates that if the compression and joining of composite streams in which a soluble component and a slightly soluble component are arranged relatively at equal intervals are combined multiple times, a sea-island composite fiber in which fine fibers of the slightly soluble component are disposed in the cross section of the composite fiber can be obtained. In that technique, certainly in the cross section of the sea-island composite fiber, the island component fibers may be regularly arranged in the inner layer portion. However, when each of composite streams is reduced in size, the outer layer portion is affected by shearing by the hole wall of the spinneret. Consequently, in the cross sectional direction of the reduced composite stream, a flow velocity distribution is generated, and the slightly soluble component fibers in the outer layer of the composite stream and those in the inner layer become greatly different from each other in fiber diameters and forms. In the technique of JP '858, to achieve island component fibers of the nano-order, the above-mentioned operation must be repeated multiple times before the final discharge. Therefore, the difference in the distributions of cross sectional forms in the cross sectional direction of the composite fiber may become very large as the case may be, and variations in island component fiber diameters and cross sectional forms occur.

In JP 2007-100243 A, as the spinneret technique, a known conventional sea-island composite spinneret using pipes is used, and the melt viscosity ratio between a soluble component and a slightly soluble component is specified so that a sea-island composite fiber with a relatively controlled cross sectional form can be obtained. Further, JP '243 indicates that if the soluble component is dissolved in a later step, ultrafine fibers with a uniform fiber diameter can be obtained. However, in that technique, the slightly soluble component divided into fine lines by pipes is once formed into sheath-core composite streams using sheath-core conjugating holes, and the composite streams are joined and subsequently reduced in size to obtain a sea-island composite fiber. The formed sheath-core composite streams are completely round in cross sectional form due to the surface tension acting after discharge from the conjugating holes. Consequently, it is very difficult to positively control the form. Therefore, there is a limit in controlling the cross sectional forms of the island component fibers, and complete circles and ellipses similar to complete circles exist together. With regard to this matter, even if the form of the hollow portion of each pipe is changed, the effect of this modification is small because of the influence of the surface tension of polymer streams. In the technique of JP '243, with regard to the variation of the circumscribed circles of the island component fibers, the circles can be made relatively uniform. However, it is very difficult to achieve a non-circularity and to make uniform the noncircular cross sectional form. Therefore, JP '243 is very limited for allowing the design of ultrafine fibers adaptable to applications and allowing the design of textile products composed of the ultrafine fibers.

In the case where the island component fibers have a completely circular or similar cross sectional form, if the fibers are simply woven and treated to remove the sea component, the ultrafine fibers with a circular cross sectional form contact each other at the tangential lines, and among the ultrafine fibers, gaps depending on the fiber diameter are formed. Further, the flexibility increases simply in response to the fiber diameter. Consequently, in the case of sports clothing, water permeates through the gaps to limit the waterproof performance. Furthermore, since the cloth is soft, such problems as displeasing stickiness and the increase of cloth weight occur as the case may be. Moreover, also in applications as wiping cloths and polishing cloths, since the ultrafine fibers have a completely circular or similarly elliptic cross sectional form, the dirt and abrasive may slip on the surfaces of the fibers. Moreover, ultrafine fibers raised on the surface layers by buffing or the like are soft and weak and therefore are limited in wiping performance and polishing performance, and in the case where the dirt and abrasives caught under ultrafine fibers are pressed at lines (tangential lines of circles), the material to be polished may be flawed unnecessarily as the case may be.

WO 89/02938 proposes a distribution type spinneret in which fine grooves and holes are used to form polymer passages, and conjugation is performed immediately before and/or immediately after discharge to form a complicated cross sectional form. In the spinneret of this type, depending on the arrangement of holes in the final distribution plate, two or more types of polymer streams can be arranged at arbitrary points in the cross section of the fiber. Further, by joining island component fibers together, island component fibers with a noncircular cross sectional form of the micron order or a diverse composite cross section composed of the joined fibers may be able to be formed.

However, in the case where island component fibers or ultrafine fibers of the nano-order are produced, it is necessary to divide one component polymer extremely, and in the distribution holes immediately before the discharge plate, the discharge rate per hole is as extremely small as $10^{-4}$ to $10^{-5}$ g/min compared with the micron order ($10^{-0}$ to $10^{-2}$ g/min). Consequently, the pressure loss necessary for metering the amount of polymer is almost 0 kg/cm$^2$, and the polymer metering capability is very low. From this point of view, in reference to the technique of JP '243, a filter or the like is used to apply a pressure loss so that the polymer passes through quite different passages after having been metered, and is divided till immediately above the discharge plate or till the discharge surface. Therefore, the discharge rates of the island component and the sea component become uneven from place to place, and it is very difficult to form a highly precise sea-island composite cross section. In particular, to produce ultrafine fibers (island component fibers) as described before, the discharge rate per distribution hole is very small. For this reason, in the technique of WO '938, it is difficult to obtain uniform ultrafine fibers in view of the precision of the sea-island composite cross section.

Further, in the passages (hole arrangement and grooves) presented as examples in WO '938 and in the description, the abnormal retention that some polymer streams become hard to flow is not taken into consideration. Therefore, in the case where a branch hole is closed halfway in a passage, the polymer does not flow through the branch hole on the downstream side at all, or the amount of the subsequent polymer stream is greatly decreased. Accordingly, in the technique of WO '938, if a branch hole is closed, all the polymer that should flow through the branch hole flows through other branch holes, and the cross sectional mode of the composite polymer streams becomes greatly different from the intended cross sectional mode. Further, when the composite polymer streams obtained by discharging from respective distribution holes and joining the discharged streams are compressed and discharged, it is not considered to protect the composite polymer streams. For this reason, the decline in the precision of composite cross section is further promoted.

It could therefore be helpful to provide a sea-island composite fiber that can be converted into ultrafine fibers having an extreme fineness of the nano-order, which, as island component fibers, have a non-circularity and are uniform in the noncircular cross sectional form.

SUMMARY

We thus provide a sea-island composite fiber and ultrafine fibers produced from the sea-island composite fiber, which have a non-circularity and are very small in the variation of non-circularity, i.e., uniform in the non-circular form.

In particular, we provide:

(1) A sea-island composite fiber characterized in that the island component fibers have a circumscribed circle diameter in a range from 10 to 1000 nm, a circumscribed circle diameter variation of 1 to 20%, a non-circularity of 1.2 to 5.0, and a non-circularity variation of 1 to 10%.

(2) A sea-island composite fiber, according to (1), wherein in the cross section in the direction perpendicular to the fiber axis of each of the island component fibers, the outline of the cross section has at least 2 or more straight line segments.

(3) A sea-island composite fiber, according to (1) or (2), wherein each of the angles θ at the intersection points formed between the straight line segments satisfies the following formula:

$$\frac{25(5n-9)}{n} \leq \theta \leq 170$$

where n is the number of intersection points (n is an integer of 2 or more).

(4) A sea-island composite fiber, according to any one of (1) through (3), wherein there are 3 or more intersection points formed between the straight line segments.

(5) Ultrafine fibers obtained by treating the sea-island composite fiber set forth in any one of (1) through (4) for removing the sea component.

(6) Ultrafine fibers, according to (5), which are a multifilament consisting of single fibers with a fiber diameter of 10 to 1000 nm, a fiber diameter variation of 1 to 20%, a non-circularity of 1.2 to 5.0 and a non-circularity variation of 1 to 10.

(7) Ultrafine fibers, according to (5) or (6), which have a tensile strength of 1 to 10 cN/dtex, and an initial modulus of 10 to 150 cN/dtex.

(8) Ultrafine fibers, according to any one of (5) through (7), wherein in the cross section in the direction perpendicular to the fiber axis of each of single fibers, the outline of the fiber cross section has at least 2 or more straight line segments.

(9) Ultrafine fibers, according to any one of (5) through (8), wherein there are 3 or more intersection points formed between the extension lines of every two straight line segments adjacent to each other.

(10) A textile product, at least a part of which is constituted by the fibers set forth in any one of (1) through (9).

(11) A composite spinneret for discharging a composite polymer stream consisting of at least two or more component polymers, which comprises a metering plate having multiple metering holes for metering the respective component polymers, a distribution plate with multiple distribution holes formed in the distribution grooves for joining the polymer streams discharged from the metering holes, and a discharge plate.

(12) A composite spinneret, according to (11), wherein 2 to 10 constituent plates are laminated as the metering plate of the composite spinneret.

(13) A composite spinneret, according to (11) or (12), wherein 2 to 15 constituent plates are laminated as the distribution plate of the composite spinneret.

(14) A composite spinneret, according to any one of (11) through (13), wherein the constituent distribution plate immediately above the discharge plate of the composite spinneret has multiple distribution holes formed for at least one component polymer, to surround the outermost layer of the composite polymer stream.

(15) A composite spinneret, according to any one of (11) through (14), wherein the discharge plate of the composite spinneret has discharge holes and introduction holes formed to ensure that multiple polymer streams discharged from the distribution plate may be introduced in the direction perpendicular to the distribution plate.

(16) A composite spinneret, according to any one of (11) through (15), wherein the distribution holes for a sea component polymer are formed on the circumference with each distribution hole for an island component polymer fiber as the center in such a manner that the following formula may be satisfied, in the constituent distribution plate immediately above the discharge plate:

$$\frac{p}{2} - 1 \leq hs \leq 3p$$

where p is the number of vertexes of each island component fiber (p is an integer of 3 or more), and hs is the number of distribution holes for the sea component.

(17) A sea-island composite fiber obtained by using the composite spinneret set forth in any one of (11) through (16).

(18) A sea-island composite fiber set forth in (1) obtained by using the composite spinneret set forth in any one of (11) through (16).

(19) A method for producing the sea-island composite fiber set forth in (1) by using the composite spinneret set forth in any one of (11) through (16).

The sea-island composite fiber has island component fibers that are extremely reduced in size to the order of nano size and are noncircular in the cross sectional form, being uniform in the diameter and the cross sectional form.

The first feature of the sea-island composite fiber is that the island component fibers of the nano-order are very uniform in their diameter and form. Therefore, in the case where a tension is applied, all the island component fibers bear the tension equally in the cross sections thereof, and the stress distribution on the cross sections of fibers can be inhibited. This effect means that the breakage of the composite fibers are hard to occur in the subsequent processing where relatively high tensions act such as the drawing step, weaving step and salt component removing treatment step. For this reason, the composite fibers allow textile products to be obtained at high productivity. Further, there is also another effect that the same processing speeds take place in the salt component removing treatment step irrespective of island component fibers since the island component fibers are uniform in the form. Therefore, the partial breakage, dropout and the like of island component fibers (ultrafine fibers) by the solvent can be inhibited. In particular in the case where the fiber diameter is on the order of nano size, slight variations in the diameter and form of island component fibers greatly affect the processing speed, and therefore the uniformity in the form of the island component fibers in the sea-island composite fiber acts effectively.

The second feature of the sea-island composite fiber is that the island component fibers of the nano-order have a noncircularity. Consequently, the ultrafine fibers produced from the sea-island composite fiber have uniformly controlled noncircular cross sections in addition to the fiber diameter of the nano-order. Therefore, the textile product obtained by using the ultrafine fibers, which has a touch peculiar to the fibers of the nano-order, allows the cloth properties such as repellency and friction coefficient to be freely controlled by the cross sectional form of the ultrafine fibers. This effect allows, needless to say, the ultrafine fibers to be used as textile products of new senses for the clothing application, and an excellent effect can be exhibited also in the sports clothing used under severe conditions. In particular, the ultrafine fibers produced from the sea-island composite fiber have excellent waterproof and moisture-permeable performance owing to a close-packed structure. Further, only if the cross sectional form of the ultrafine fibers is merely changed to suit a region of the human body, comfortable waterproof and moisture-permeable clothing that maintains waterproof performance and yet does not stick to the skin displeasingly even in a sweaty region can be designed.

Furthermore, the ultrafine fibers produced from the sea-island composite fiber are suitable as wiping cloths, precision polishing cloths for IT and the like. The reason is that the edges of the noncircular cross sections of the ultrafine fibers can be used. Therefore, the ultrafine fibers allow the wiping performance, dust and dirt collection performance and polishing properties to be dramatically enhanced compared with the conventional ultrafine fibers with circular cross sections. Further, since the ultrafine fibers are excellently uniform in the fiber form, the surface properties of the cloths are very uniform and unnecessary flawing can be inhibited. Furthermore, as described before, since the mechanical properties and surface properties of cloths can be controlled, polishing properties can also be controlled. Accordingly, even if the polishing conditions such as pressing pressure are not adjusted, excessive polishing can be inhibited.

BRIEF DESCRIPTION OF THE DRAWINGS

FIG. 2(*a*) is a front sectional view showing a major portion constituting a composite spinneret. FIG. 2(*b*) is a transverse sectional view showing a portion of a distribution plate. FIG. 2(*c*) is a transverse sectional view showing a discharge plate.

REFERENCE SYMBOLS

Figure 1:
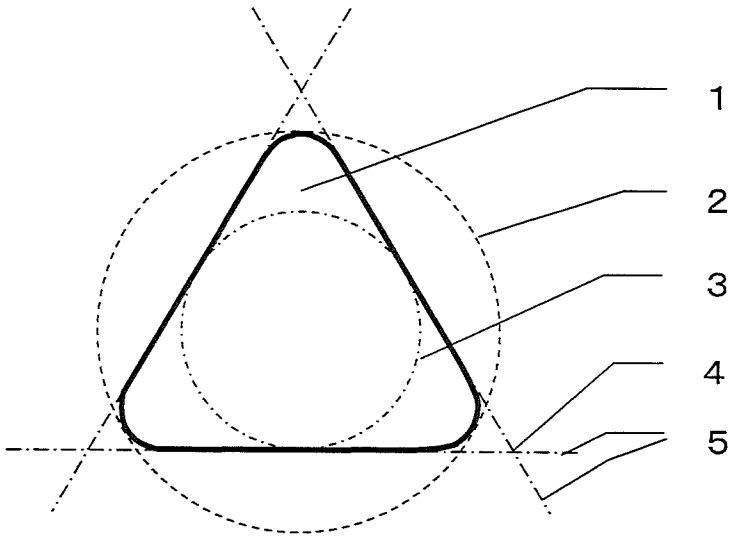
FIG. 1 is a schematic drawing showing an example of an island component fiber or an ultrafine fiber of a sea-island composite fiber.

1 Island component fiber of sea-island composite fiber
2 circumscribed circle
3 inscribed circle
4 intersection point
5 extension line
6 metering plate
7 distribution plate
8 discharge plate
9 metering hole
9-(*a*) metering hole (1)
9-(*b*) metering hole (2)
10 distribution groove
10-(*a*) distribution groove (1)
10-(*b*) distribution groove (2)
11 distribution hole
11-(*a*) distribution hole (1)
11-(*b*) distribution hole (2)
12 discharge introduction hole
13 reducing hole
14 discharge hole
15 annular groove
16 example 1 of island component fiber of sea-island composite fiber
17 example 2 of island component fiber of sea-island composite fiber

DETAILED DESCRIPTION

Our fibers, composite spinnerets and methods are described below in detail together with desirable examples.

In the sea-island composite fiber, two or more polymers form a fiber cross section in the direction perpendicular to the fiber axis. In this case, the composite fiber has a cross sectional structure in which island component fibers formed of a certain polymer are dotted in the sea component formed of another polymer.

As the first and second constituent features of the sea-island composite fiber, it is important that the circumscribed circle diameter of the island component fibers is 10 to 1000 nm, and that the circumscribed circle diameter variation is 1 to 20%.

The circumscribed circle diameter referred to here is obtained as described below. That is, a multifilament as a sea-island composite fiber is embedded in an embedding agent, and ten or more images of transverse cross sections of the multifilament are photographed at a magnification capable of observing more than 150 island component fibers by using a transmission electron microscope (TEM). In this case, if the multifilament is dyed with a metal, the contrast of the island component fibers can be made clear. From the image of each photographed fiber cross section, the circumscribed circle diameters of 150 island component fibers sampled at random in the image are measured. The circumscribed circle diameter referred to here means the diameter of a complete circle circumscribing the cut face of each island component fiber obtained by cutting as a cross section in the direction perpendicular to the fiber axis from the two-dimensionally photographed image. FIG. 1 is a schematic drawing of an island component fiber, and the circle indicated by a broken line (symbol 2 in FIG. 1) in FIG. 1 is the circumscribed circle referred to here. Further, with regard to the value of the circumscribed circle diameter, the diameter is measured in nm to the first decimal place, and in the measured value, a fraction of 0.5 or over is counted as 1 and the rest is cut away. Further, the circumscribed circle diameter variation is the value calculated as the circumscribed circle diameter variation on the basis of the measured results of the circumscribed circle diameters from "(Circumscribed circle diameter CV %)=(Standard deviation of the circumscribed circle diameters/Mean value of the circumscribed circle diameters)×100 (%)," and in the calculated value, a fraction of 0.05 or over is counted as 0.1 and the rest is cut away. The above operations are performed on the 10 photographed images, and the simple number averages of the values obtained by measuring the respective images are obtained as the circumscribed circle diameter and the circumscribed circle diameter variation.

In the sea-island composite fiber, the circumscribed circle diameter of island component fibers can also be kept less than 10 nm, but if the circumscribed circle diameter is kept at 10 nm or more, for example, it can be inhibited that the island component fibers are partially broken in the production process.

On the other hand, to achieve the sea-island composite fiber, it is necessary that the circumscribed circle diameter of island component fibers is 1000 nm or less. From the viewpoint of greatly enhancing the wiping performance and the like compared with the prior art, it is preferred that the circumscribed circle diameter of island component fibers is 100 to 700 nm. If the diameter is in this range, an effect that the dirt on the surface of the material to be wiped can be scraped well can be obtained without the dropout of fibers at the time of pressing. Further, considering higher polishing performance, a more preferred range of the circumscribed circle diameter of island component fibers is 100 to 500 nm, since the grain size of the abrasive grains is approx. 100 to approx. 300 nm. If the diameter is in this range, the ultrafine fibers can also be suitably used for precision polishing for IT application and the like. Further, in the case where the diameter is in this range, if the ultrafine fibers are used as a wiper, the wiper exhibits excellent wiping performance and dust and dirt collection performance needless to say.

It is necessary that the circumscribed circle diameter variation of island component fibers is 1 to 20%. If the variation is in this range, it means that there are no locally coarse island component fibers. Consequently the stress distribution in the fiber cross sections in the subsequent process is inhibited, and the capability of smoothly undergoing the process becomes good. In particular, the effect in the capability of smoothly undergoing the drawing step, weaving step and sea component removing treatment step in which the tension is relatively high is large. Further, the ultrafine fibers after having been subjected to the sea component removing treatment step are also similarly uniform. Therefore, the surface properties and wiping performance of the textile product composed of the ultrafine fibers do not partially change, and the textile product can be used as a high performance wiper or polishing cloth. From such a point of view, it is preferred that the circumscribed circle diameter variation of island component fibers is smaller, and a range from 1 to 15% is preferred. Further for applications requiring higher precision such as high performance sports clothing and precision polishing for IT, if the circumscribed circle diameter variation is smaller, the ultrafine fibers can be bundled at a high density. Consequently it is preferred that the circumscribed circle diameter variation is 1 to 7%.

The third and fourth constituent features of the sea-island composite fiber are that the island component fibers have a non-circularity of 1.2 to 5.0 and a non-circularity variation of as very small as 1 to 10%.

With regard to the non-linearity in this case, 10 images of cross sections of island component fibers are photographed two-dimensionally by the same method as the aforementioned method for the circumscribed circle diameter and the circumscribed circle diameter variation. From each image, the circumscribed circle diameter and the diameter of the complete circle inscribing each island component fiber as the inscribed circle diameter are measured, and from Non-circularity= Circumscribed circle diameter÷ Inscribed circle diameter, the non-circularity is obtained to the third decimal place. In the calculated value, a fraction of 0.005 or over is counted as 0.01 and the rest is cut away to obtain the non-circularity. The non-circularity is measured with 150 island component fibers sampled at random in the same image. The non-circularity variation is the value calculated as the non-circularity variation using the mean value and the standard deviation of the non-circularity values from (Non-circularity CV %)= (Standard deviation of non-circularity values/Mean value of non-circularity values)×100 (%), and in the calculated value, a fraction of 0.05 or over is counted as 0.1 and the rest is cut away. The above operations are performed for 10 photographed images, and the simple number averages of the values measured for the respective images are obtained as the non-circularity and the non-circularity variation.

The non-circularity is less 1.1 in the case where the cut face of an island component fiber is a complete circle or an ellipse close to it. Further, in the case where the conventional sea-island composite spinneret using pipes is used for spinning, the island component fibers in the outermost layer of the cross section become deformed ellipses, and the non-circularity may become 1.2 or more as the case may be. However, in this case, since the non-circularity variation increases, the ultrafine fibers do not comply with this disclosure. Further, in this case, the circumscribed circle diameter variation increases likewise.

The largest feature of the sea-island composite fiber is that the island component fibers have a diameter of the nano-size order and have a non-circularity, i.e., a cross sectional form different from a complete circle, and the individual island component fibers have almost the same cross sectional form.

As the island component fibers of the sea-island composite fiber, it is important that the non-circularity is 1.2 to 5.0.

In the case where the cross sections of island component fibers are complete circles or ellipses close to them, after the sea component removing treatment, the ultrafine fibers contact each other at the tangential lines of the circles. Consequently, in the fiber bundle, gaps depending on the fiber diameters are formed among the single fibers. Therefore, the residue of the sea component may be caught in the gaps at the time of sea component removing treatment as the case may be. This, in combination with the increase in the specific surface area of ultrafine fibers, may often lower the openability of the ultrafine fibers as the case may be when the ultrafine fibers of the nano-order are produced. The island component fibers of the sea-island composite fiber have a non-circularity of 1.2 or more. Consequently, the single fibers can contact each other via planes. As a result, unnecessary gaps are not formed and the residue of the sea component very rarely remains among the ultrafine fibers. Further, since the ultrafine fibers of the sea-island composite fiber have a non-circularity, the bending properties of the ultrafine fibers per se are enhanced, and in addition as described later, the ultrafine fibers have projected portions, allowing the ultrafine fibers of the nano-order to be sufficiently opened. From the viewpoint of keeping such openability good, it is preferred that the non-circularity is 1.5 to 5.0.

Further, if the non-circularity of ultrafine fibers is larger compared to the conventional completely circular ultrafine fibers, the surface properties and mechanical properties of the cloths become more different. For this reason, from the viewpoint of controlling the cloth properties, it is more preferred that the non-circularity is 2.0 to 5.0.

In the sea-island composite fiber, a large non-circularity of larger than 5.0 can also be employed. However, from the viewpoint of controlling the non-circularity variation, the non-circularity that can be substantially produced is 5.0.

In each of the island component fibers of the sea-island composite fiber, it is preferred that the outline of the cross sectional form has at least two or more straight line segments. If so, in the case where the ultrafine fibers obtained by the sea component removing treatment are used as a wiping cloth, polishing cloth or the like, the performance of scraping dirt well can be enhanced. The reason is that if straight line segments exist in the cross sections of the ultrafine fibers on the surface layer portion, the ultrafine fibers closely contact the surface of the material to be polished. Further, in the case where an external force such as a pressing force acts on the fiber structure, the ultrafine fibers circular in the cross sectional form are likely to roll, but ultrafine fibers having straight line segments are likely to fix the ultrafine fibers each other. Thus, it is inhibited that the pressing pressure or the like is diffused, and it is not necessary to excessively press the textile product to the material to be polished. Therefore, compared with the conventional ultrafine fibers not having straight line segments in the outlines of the cross sections, it can be inhibited that the material to be polished or the like is flawed unnecessarily. In the dry wiping cloth or high-performance polishing cloth for IT requiring higher wiping performance or higher polishing performance, it is especially preferred that there are three or more straight line segments.

The straight line segment in a cross sectional form referred to here means a line segment having two end points, which is straight in the outline of the cross section of a single fiber in the direction perpendicular to the fiber axis. The straight line segment referred to here is a line segment having a length corresponding to 10% or more of the circumscribed circle diameter, and is evaluated as follows.

Like the aforementioned method, 10 images of cross sections of the composite fiber are photographed, and the outlines of the cut faces of 150 island component fibers sampled at random within each of the 10 images are evaluated. FIG. 1 shows an island component fiber having a triangular cross section as an example. This example has three straight line segments. Meanwhile, in the case where the cross sectional form is a circle or an ellipse close to it, it does not have any straight line segment. The number of straight line segments in 150 island component fibers is counted, and the total sum is divided by the number of island component fibers, to calculate the number of straight line segments per island component fiber. In the calculated value, a fraction of 0.05 or over is counted as 0.1 and the rest is cut away. This operation is performed for 10 photographed images, and the simple number average of the values obtained by measuring in the respective images is obtained as the number of straight line segments.

Further, with regard to the cross sectional form of an island component fiber, it is preferred that the angle at the intersection point between the extension lines of every two straight line segments adjacent to each other satisfies the following formula:

$$\frac{25(5n-9)}{n} \leq \theta \leq 170$$

where n is the number of intersection points (n is an integer of 2 or more).

This means that the projected portions existing in the cross section are sharp, i.e., have edges. If θ is 170° or less, the edges of the produced ultrafine fibers can easily scrape dirt, thereby further enhancing wiping performance and polishing performance. On the other hand, from the viewpoint of being able to maintain the forms of the projected portions even in the case where an external force such as a pressing force acts, it is preferred that θ is 25(5n−9)/n or more. Further, θ being 25(5n−9)/n or more means that the island component fiber is substantially a regular polygon. In this range, the lengths of the straight line segments of the island component fiber are almost equal to each other. For this reason, unnecessary gaps are not likely to be formed among the island component fibers or the produced ultrafine fibers, and the ultrafine fibers are likely to form a close-packed structure. Further, since all the faces are uniform, there is an effect that the bending properties of the produced ultrafine fibers and the surface properties of the cloth composed of the ultrafine fibers can be easily controlled. From the aforementioned point of view, an especially preferred range of θ is 50° to 150°.

For the θ referred to here, the angle is measured at the intersection (4) formed between every two extension lines adjacent to each other as the extension lines indicated by symbol 5 in FIG. 1 drawn from the straight line segments existing on the outline of the cross section of each of 150 island component fibers sampled by the aforementioned method. The acutest angle among the intersection points of each island component fiber is recorded. The total sum of the recorded angles is divided by the number of islands, and in the calculated value, a fraction of 0.5 or over is counted as 1 and the rest is cut away, to decide the angle at the intersection. This operation is performed for 10 images, and the simple number average is employed as θ.

Meanwhile, it is preferred that the aforementioned number of intersection points is larger, i.e., the number of projected portions is larger. Specifically a preferred range of the number of intersection points is 3 or more. That is, if 3 or more projected portions exist, the island component fibers repel each other at the time of sea component removing treatment, and there is no influence of the adhesion due to the residue. Consequently, even ultrafine fibers of the nano-order can be opened well.

Further, in the textile product composed of the ultrafine fibers obtained from the sea-island composite fiber, projected portions are likely to exist on the surface layer. Therefore, the textile product is likely to exhibit scraping performance. Further, the existence of three or more intersection points means that the island component fiber is substantially polygonal. That is, since the single fibers contact each other at their lateral faces, it is inhibited that the fibers roll in the surface layer of a textile product. Especially in the case where the ultrafine fibers have uniform cross sectional forms, there is a synergism that the ultrafine fibers are likely to form a close-packed structure. From the viewpoint of forming a close-packed structure, an especially preferred range of the number of intersection points is 10 or less.

Since the sea-island composite fiber has an unprecedented cross sectional form, it can exhibit the aforementioned effects for the first time. Therefore, if the island component fibers are greatly different in the cross sectional form as in the prior art, the effects may be greatly impaired as the case may be. The reason is that since the cross sectional forms of the island component fibers are different, the sea component removing treatment rates become different from island component fiber to island component fiber, and the variation of the cross sectional forms of the island component fibers is promoted in the sea component removing treatment step. Further, the mechanical properties of the ultrafine fibers subjected to excessive sea component removing treatment due to small fiber diameters and the like decline, and the dropout of ultrafine fibers may become a problem as the case may be. Also in the case where the ultrafine fibers are processed into a textile product, there is a problem that the aforementioned inhibition of gap formation, partial changes in the touch of the textile product, and many performances such as waterproof performance and polishing performance become uneven.

From the above-mentioned viewpoint, it is important that the non-circularity variation of island component fibers is 1 to 10%. This range expresses that the island component fibers have almost the same cross sectional form. This uniformity of cross sectional form means that the cross section of the sea-island composite fiber uniformly bears the stresses acting in the subsequent process. That is, drawing at a high ratio or the like can be performed in the drawing step, to provide high mechanical properties, and such process troubles as fiber breaking and cloth breaking can be prevented in subsequent processing. Further, the surface properties of the textile product composed of the produced ultrafine fibers become uniform. Therefore, enhancement of waterproof performance, wiping performance, polishing performance and dust and dirt collection performance by the close-packed structure can be achieved. An especially preferred range of the non-circularity variation is 1 to 7%, and the aforementioned performances can be remarkably enhanced.

It is preferred that the sea-island composite fiber has a tensile strength of 0.5 to 10 cN/dtex and a breaking elongation of 5 to 700%. The strength referred to here is the value obtained by dividing the load value at break found on the load-elongation curve of the multifilament obtained under the condition shown in JIS L1013 (1999), by the initial fineness, and the breaking elongation is the value obtained by dividing the elongation at break by the initial sample length. Further, the initial fineness means the value calculated from the obtained fiber diameter, number of filaments and density, or the value obtained by calculating the weight per 10000 m from the simple average of the weights per unit length of the fiber measured multiple times. It is preferred that the tensile strength of the sea-island composite fiber of this invention is 0.5 cN/dtex or more to ensure the capability of smoothly undergoing the subsequent process and to endure the practical use. The upper limit that can be practically achieved is 10 cN/dtex. Further, it is preferred that the breaking elongation is also 5% or higher, considering the capability of smoothly undergoing the subsequent process, and the upper limit that can be practically achieved is 700%. The tensile strength and the breaking elongation can be adjusted by controlling the conditions in the production process in response to intended applications.

The sea-island composite fiber can be processed into various intermediate products such as wound fiber packages, tows, cut fibers, artificial cotton, fiber balls, cords, piles, woven fabrics, knitted fabrics and nonwoven fabrics, and can also be subjected to the sea component removing treatment or the like to produce ultrafine fibers, for use as various textile products. Further, the sea-island composite fiber, which is not treated, or treated to partially remove the sea component, or treated to remove the island component, can also be processed into textile products needless to say. The textile products referred to here can be used as general clothing such as jackets, skirts, underpants and underwear, sports clothing, clothing materials, interior products such as carpets, sofas and curtains, vehicle interior products such as car seats, living applications such as cosmetics, cosmetic masks, wiping cloths and health articles, environmental/industrial material applications such as filters, harmful material removing products and battery separators, and medical applications such as sutures, scaffolds, artificial blood vessels and blood filters.

The ultrafine fibers produced from the sea-island composite fiber have an extreme fiber diameter of 10 to 1000 nm on the average, and it is preferred that the fiber diameter variation is 1 to 20%.

The fiber diameter of ultrafine fibers referred to here is obtained as follows. That is, the multifilament composed of the ultrafine fibers produced by subjecting a sea-island composite fiber to the sea component removing treatment is embedded in an embedding agent such as an epoxy resin, and the transverse cross section of the multifilament is photographed at a magnification capable of observing 150 or more ultrafine fibers by using a transmission electron microscope (TEM). In this case, if the outlines of the ultrafine fibers are not clear, they can be dyed with a metal. The fiber diameters of 150 ultrafine fibers sampled at random from the image within the same image are measured. In this case, the fiber diameters of the respective ultrafine fibers mean the diameters of the circumscribed circles of the cross sections of the ultrafine fibers, and the circle indicated by the broken line (symbol 2 in FIG. 1) in FIG. 1 is the circumscribed circle. Further, the value of a fiber diameter (circumscribed circle diameter) is measured to the first decimal place in nm, and in the measured value, a fraction of 0.5 or over is counted as 1 and the rest is cut away. As the fiber diameter of this invention, the fiber diameters of the respective ultrafine fibers are measured, and the simple number average of them is obtained. Further, the fiber diameter variation is the value calculated as the fiber diameter variation on the basis of the measured results of fiber diameters from (Fiber diameter CV %)=(Standard deviation of fiber diameters/Mean value of fiber diameters)×(100%), and in the calculated value, a fraction of 0.5 or over is counted as 1 and the rest is cut away.

From the viewpoint of preventing that ultrafine fibers become excessively fine, it is preferred that the ultrafine fibers have a fiber diameter of 10 nm or more. From the viewpoint of giving performance such as peculiar touch of ultrafine fibers, 1000 nm or less is preferred. To clarify the pliability of ultrafine fibers, especially preferred is 700 nm or less. Further, a preferred range of the fiber diameter variation is from 1.0 to 20.0%. Since this range means that coarse fibers do not exist locally, partial changes in the surface properties and wiping performance of the textile product are very small. It is preferred that the variation is smaller, and especially for use as high-performance sports clothing and precision polishing for IT, a more preferred range is 1.0 to 10.0%.

It is preferred that the non-circularity of the ultrafine fibers is 1.2 to 5, and that the non-circularity variation is 1.0 to 10.0%.

With regard to the non-circularity referred to here, the cross sections of ultrafine fibers are photographed two-dimensionally by the same method as that for the aforementioned fiber diameter and the fiber diameter variation, and from the image, the diameter of the complete circle circumscribing the cut face of each fiber is identified as the circumscribed circle diameter (fiber diameter) and further the diameter of the complete circle inscribing is identified as the inscribed circle diameter. Then, from Non-circularity= Circumscribed circle diameter÷ Inscribed circle diameter, the non-circularity is calculated to the third decimal place, and in the calculated value, a fraction of 0.005 or over is counted as 0.01 and the rest is cut away. The inscribed circle referred to here indicates the one-dot-dash line (symbol 3 in FIG. 1) in FIG. 1. The non-circularity is measured for each of 150 ultrafine fibers sampled at random within the same image. The non-circularity variation referred to is calculated as the non-circularity variation using the mean value and standard deviation of the non-circularity values from (Non-circularity CV %)=(Standard deviation of non-circularity values/Mean value of non-circularity values)×100 (%), and in the calculated value, a fraction of 0.05 or over is counted as 0.1 and the rest is cut away.

The ultrafine fibers have a feature that though the ultrafine fibers have fiber diameters of the nano-order, they have a non-circularity. That is, the feature is that the ultrafine fibers have a cross sectional form different from complete circles and that the individual ultrafine fibers have almost the same cross sectional form. Therefore, it is preferred that the ultrafine fibers obtained by removing the sea component have a non-circularity of 1.2 to 5.0. If the non-circularity is 1.2 or more, the single fibers can contact with each other via planes, and a multifilament or a textile product composed of the ultrafine fibers can have a close-packed structure. From the viewpoint of keeping the non-circularity variation small, the non-circularity of the ultrafine fibers, which can be substantially produced, is 5.0.

It is preferred that the outline of the cross sectional form of each of the ultrafine fibers has at least two or more straight line segments. If two or more straight line segments exist, wiping performance and the like are greatly enhanced.

The straight line segment referred to here means that a line segment having two end points, which is straight in the outline of the cross section of a single fiber in the direction perpendicular to the fiber axis and which has a length corresponding to 10% or more of the fiber diameter. This straight line segment is evaluated as follows.

Like the same method as that for the aforementioned fiber diameter and the fiber diameter variation, the cross sections of ultrafine fibers are photographed two-dimensionally, and the cross sections of 150 ultrafine fibers sampled at random from the image within the same image are evaluated. In this case, the cross sections of the ultrafine fibers are the cut faces of the ultrafine fibers in the direction perpendicular to the fiber axes in the two-dimensionally photographed image, and the outlines of the cut faces are evaluated. The number of straight line segments of 150 ultrafine fibers is counted, and the total sum is divided by the number of ultrafine fibers, to calculate the number of straight line segments per one ultrafine fiber. In the calculated value, a fraction of 0.05 or over is counted as 0.1 and the rest is cut away.

Further, in the sectional form of the ultrafine fibers, it is preferred that the angle at the intersection point formed by the extension lines of every two straight line segments adjacent to each other is 20° to 150°. This expresses that the projected portions existing on the cross sections of the ultrafine fibers are sharp, and if the angle is 150° C. or smaller, the single fibers can easily scrape dirt. Therefore, wiping performance and polishing performance can be enhanced. On the other hand, even in the case where an external force such as pressing force acts, the projected portions can maintain their forms, and from the viewpoint of exhibiting excellent wiping performance or the like, it is preferred that the angle is 20° or larger.

With regard to the angle at an intersection point referred to here, the cross sections of 150 ultrafine fibers are photographed two-dimensionally by the aforementioned method, and extension lines are drawn as indicated by symbol 5 in FIG. 1 from the straight line segments existing on the outline of each cross section. The angle at the intersection point formed between every two extension lines adjacent to each other is measured, and the total sum of the angles is divided by the number of intersection points. In the calculated value, a fraction of 0.5 or over as 1 and the rest is cut away to obtain the angle at an intersection point of one ultrafine fiber. The same operation is performed for 150 ultrafine fibers, and the simple number average is employed as the angle at an intersection point.

Meanwhile, if the number of the aforementioned intersection points is larger, that is, if more projected portions exist, the wiping performance can be enhanced needless to say, and 3 or more is a preferred range. That is, if three or more projected portions exist, projected portions are likely to exist on the surface layer of a textile product. Consequently the aforementioned scraping performance is likely to be exhibited.

In the ultrafine fibers, it is preferred that the non-circularity variation is 1.0 to 10.0%. The variation of this range expresses that the ultrafine fibers have almost the same form, and the textile product is uniform from the viewpoint of surface properties. An especially preferred range of the non-circularity variation is 1.0 to 6.0%. In this range, the effect of uniforming the cross sections is outstanding, and the enhancement of waterproof performance, wiping performance, polishing performance and dust and dirt collection performance by the close-packed structure can be expected.

Further, the uniform cross sectional form of fibers acts effectively also on the mechanical properties of the multifilament composed of ultrafine fibers. For example, in the case where an external force is applied in the fiber axis direction, all the ultrafine fibers equally bear the external force. Consequently, it can be inhibited that stresses are unnecessarily concentrated on specific single fibers. Further, the close-packed structure exhibited by having a non-circularity inhibits the partial loosening of single fibers. Therefore, the multifilament composed of ultrafine fibers bears the external force as an aggregate. For this reason, the uniformity of the cross sections and the close-packed structure greatly contribute to the enhancement of mechanical properties, particularly tensile strength. Especially in the case of ultrafine fibers of the nano-order, each of which is low in the capability to bear the external force, the effect of enhancing mechanical properties (inhibiting breakage) by the uniformity of cross sectional form and the close-packed structure is large. Further, the uniformity of cross sectional form means that the spinning stress and the draw stress in the spinning and drawing process are uniformly borne by the ultrafine fibers. Therefore, drawing at a high ratio and the like are performed to highly orient the fiber structure of the ultrafine fibers, thereby giving a high initial modulus. As a matter of course, the uniformity of cross sections and the close-packed structure mentioned before exhibit an effect also from the viewpoint of initial modulus, and the ultrafine fibers realize high mechanical properties.

It is preferred that the ultrafine fibers have a tensile strength of 1 to 10 cN/dtex and an initial modulus of 10 to 150 cN/dtex. The strength referred to here is the value obtained by dividing the load value at break found on the load-elongation curve of the multifilament obtained under the condition shown in JIS L1013 (1999), by the initial fineness, and the initial modulus is the value obtained from the gradient of the straight line approximating the initial rise portion of the load-elongation curve of the multifilament. Further, the initial fineness means the value calculated from the obtained fiber diameter, number of filaments and density, or the value obtained by calculating the weight per 10000 m from the simple average of the weights per unit length of the multifilament composed of ultrafine fibers measured multiple times.

It is preferred that the tensile strength of the ultrafine fibers is 1 cN/dtex or more to ensure the capability of smoothly undergoing the subsequent process and to endure the practical use. The upper limit that can be practically achieved is 10 cN/dtex. Further, the initial modulus referred to here means the stress the material can endure without being plastically deformed. That is, a high initial modulus means that a textile product is hard to be permanently set in fatigue even if external forces are repeatedly applied. Consequently, it is preferred that the initial modulus of the ultrafine fibers is 10 cN/dtex or more, and the upper limit value that can be practically achieved is 150 cN/dtex.

The mechanical properties such as tensile strength and initial modulus can be adjusted by controlling the conditions of the production process in response to intended applications. In the case where the ultrafine fibers are used for general clothing applications such as inner and outerwear, it is preferred that the tensile strength is 1 to 4 cN/dtex and that the initial modulus is 10 to 30 cN/dtex. Further, for sports clothing applications and the like relatively severe in use conditions, it is preferred that the tensile strength is 3 to 5 cN/dtex and that the initial modulus is 10 to 50 cN/dtex. For non-clothing applications, considering the features of the ultrafine fibers, it can be considered that the ultrafine fibers can be used as wiping cloths and polishing cloths. In these applications, the textile products are rubbed against the material to be wiped or polished, while they are pulled under load. Therefore, it is suitable that the tensile strength is 1 cN/dtex or higher and that the initial modulus is 10 cN/dtex or higher. If the mechanical properties are in these ranges, it does not happen that the ultrafine fibers are cut to drop out during wiping and the like. It is preferred that the tensile strength is in a range from 1 to 5 cN/dtex and that the initial modulus is in a range from 10 to 50 cN/dtex. The ultrafine fibers can have high mechanical strengths. Therefore, if the tensile strength is raised to 5 cN/dtex or higher while the initial modulus is raised to 30 cN/dtex or higher, the ultrafine fibers can also be used for applications called industrial materials. In particular, since a high-density woven fabric with a thin thickness can be produced, it can be folded and therefore can be used suitably as a woven fabric for air bags, tents and protection sheets.

The method for producing the sea-island composite fiber is described below in detail.

The sea-island composite fiber can be produced by spinning and drawing two or more polymers. In this case, as the method for spinning and drawing as a sea-island composite fiber, sea-island composite melt spinning is suitable from the viewpoint of enhancing productivity. As a matter of course, solution spinning or the like can also be used to obtain the sea-island composite fiber. However, as the sea-island composite spinning and drawing method, a method of using a sea-island composite spinneret is preferred from the viewpoint that the fiber diameter and the cross sectional form can be excellently controlled.

The sea-island composite fiber can also be produced by using a publicly known conventional sea-island composite spinneret using pipes. However, in the case where the cross sectional form of the island component fibers is controlled by the spinneret using pipes, it is very difficult to design and manufacture the spinneret per se. The reason is that the control of the sea component is also necessary for controlling the non-circularity and the non-circularity variation of the island component fibers. For this reason, a method of using the sea-island composite spinneret shown as an example in FIG. 2 is preferred.

Figure 2:
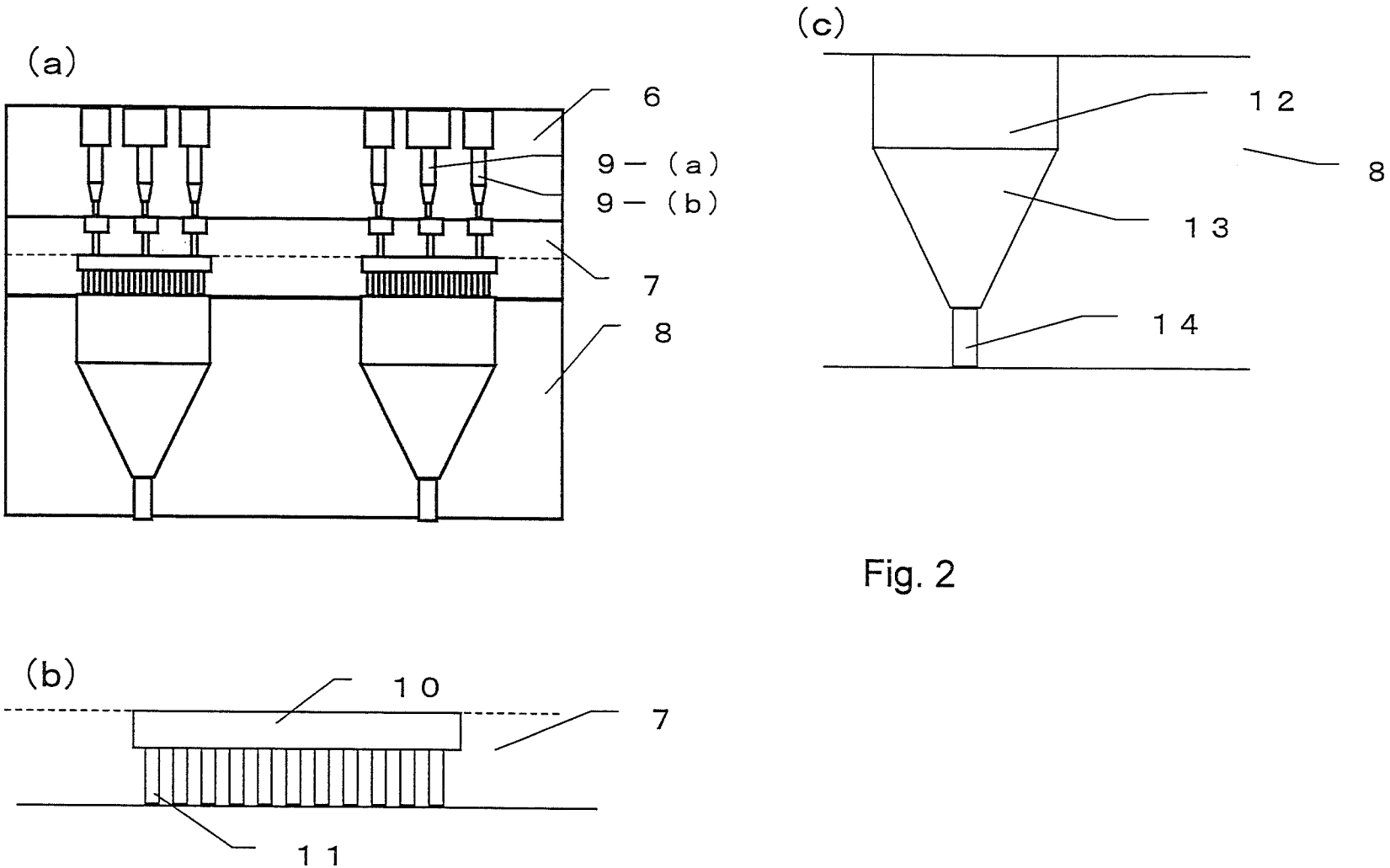
FIG. 2 are illustrations for explaining the method for producing sea-island composite fibers using an example of a composite spinneret.

The composite spinneret shown in FIG. 2, in which three major members called a metering plate (6), a distribution plate (7) and a discharge plate (8) from above are laminated, is assembled in a spin pack, to be used for spinning FIG. 2 show a case where two polymers called an island component polymer (polymer (A)) and a sea component polymer (polymer (B)) are used. In this case, if the sea-island composite fiber is used for producing ultrafine fibers by the sea component removing treatment, a slightly soluble component can be used as the island component while a soluble component can be used as the sea component. Further, as required, three or more polymers including a polymer(s) other than the slightly soluble component and the soluble component can also be used for spinning and drawing. Two soluble components different in the dissolving rate into a solvent are arranged, and the island component composed of a slightly soluble component is surrounded and covered by the soluble component with a low dissolving rate, while the other sea portion is formed by the soluble component with a high dissolving rate. As a result, the soluble component with a low dissolving rate acts as a protective layer of the island component, and can inhibit the influence of the solvent when the sea component is removed. Further, if slightly soluble components with different properties are used, the island component can be provided, in advance, with a property that cannot be obtained by the ultrafine fibers composed of a single polymer. It is difficult to achieve the above-mentioned noncircular conjugation technique by using, in particular, the conventional composite spinneret using pipes, and it is preferred to use the composite spinneret shown as an example in FIG. 2.

Among the spinneret members shown as an example in FIG. 2, the metering plate (6) meters the amounts of the polymers per each discharge hole (14) and per each of the respective distribution holes of both the sea component and the island component, for allowing subsequent flow, and the distribution plate (7) controls the single (sea-island composite) fiber cross section as the sea-island composite cross section and the cross sectional form of the island component fibers. The discharge plate (8) compresses the composite polymer streams formed by the distribution plate (7), for discharging. To avoid complicated explanation of the composite spinneret, the members laminated above the metering plate are not shown in the drawings, but can be the members that form passages for adaptation to the spinning machine and the spin pack. It is preferred that the passages have stepwise restriction holes formed for providing metering capabilities. Meanwhile, if the metering plate is designed to suit the existing passage members, the existing spin pack and the members thereof can be used as they are. Further, actually, it is preferred to laminate multiple metering plates (not shown in the drawings) between the passages and the metering plate or between the metering plate (6) and the distribution plate (7). Metering times set stepwise with the downward progression in the spinneret are suitable, and for producing the ultrafine fibers of the nano-order, it is preferred that 2 to 10 metering plates provided with restriction holes are laminated. The purpose of this configuration is to form passages for transporting the polymers efficiently in the cross sectional direction of the spinneret and in the cross sectional direction of the single fibers, and further to meter the respective component polymers stepwise. Metering the polymers stepwise as described above before the distribution plate (7) where the amount discharged per hole gradually decreases is very effective for forming precisely controlled composite cross sections. The composite polymer streams discharged from the discharge plate (8) are cooled and solidified, given an oil, and taken up as sea-island composite fibers by rollers with a specified peripheral speed, according to the conventional melt spinning method.

Figure 3:
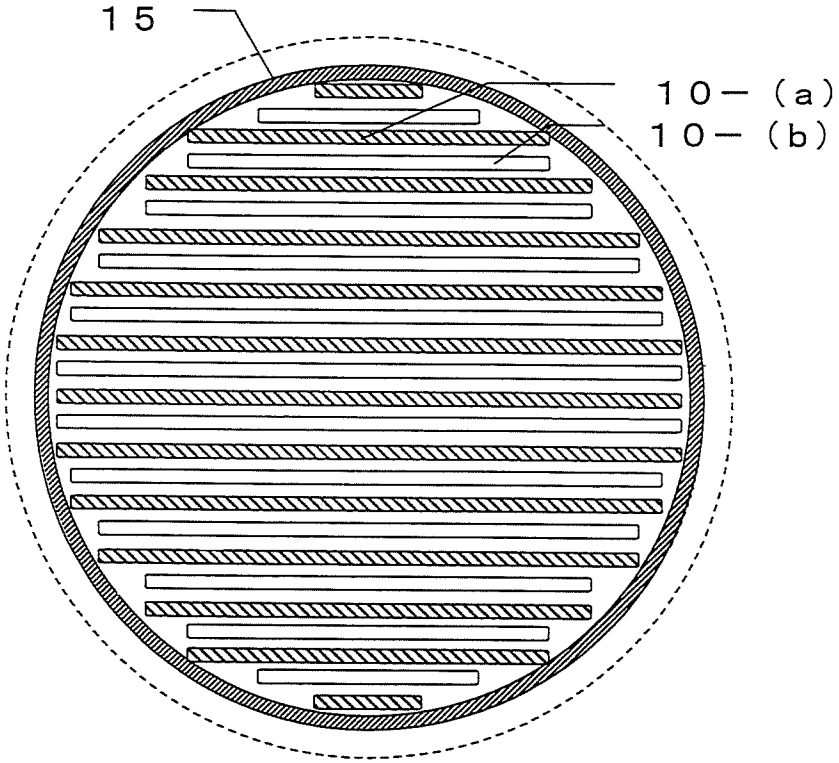
FIG. 3 shows a portion of an example of a distribution plate.
Figure 4:
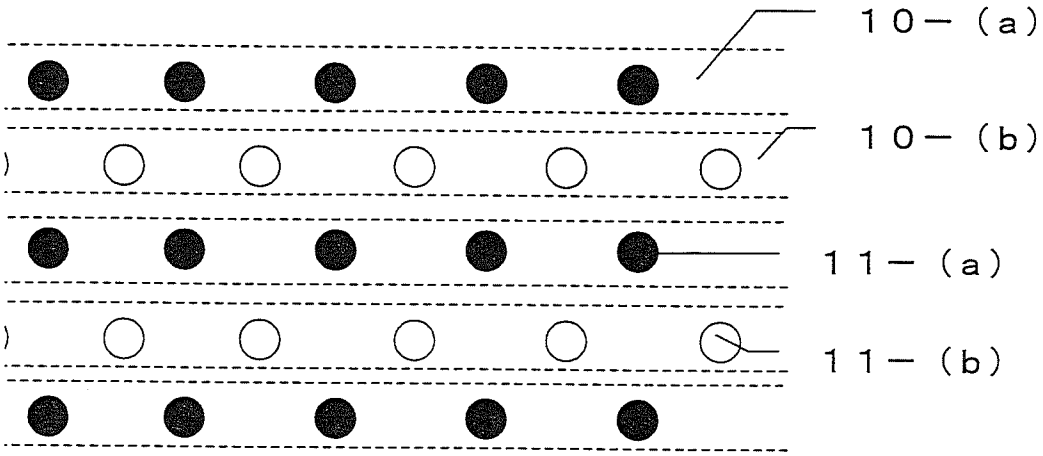
FIG. 4 shows an example of the arrangement of distribution grooves and distribution holes in a distribution plate.

An example of the composite spinneret is described in more detail in reference to the drawings (FIG. 2 to FIG. 4).

FIGS. 2(*a*) to (*c*) are illustrations for typically explaining an example of our sea-island composite spinneret. FIG. 2(*a*) is a front sectional view showing the major portion constituting the sea-island composite spinneret. FIG. 2(*b*) is a transverse cross sectional view showing a portion of the distribution plate. FIG. 2(*c*) is a transverse cross sectional view showing a portion of the discharge plate. FIGS. 2(*b*) and 2(*c*) show the distribution plate and the discharge plate constituting FIG. 2(*a*). FIG. 3 is a plan view showing the distribution plate, and FIG. 4 is an enlarged view showing a portion of the distribution plate of this invention. FIGS. 2(*b*), 2(*c*), 3 and 4 show the grooves and holes concerned with one discharge hole.

The flow of polymers from the upstream position to the downstream position in the composite spinneret, which pass through the metering plate and the distribution plate of the composite spinneret shown as an example in FIG. 2, to form composite polymer streams till the composite polymer streams are discharged from the discharge holes of the discharge plate, is explained below sequentially.

The polymer A and polymer B coming from the upstream side of the spin pack flow into polymer (A) metering holes (9-(*a*)) and polymer (B) metering holes (9-(*b*)), and are metered by the restriction holes formed at the bottom ends, then flowing into the distribution plate. In this case, the polymer (A) and the polymer (B) are metered by the pressure losses caused by the restrictors provided in the respective metering holes. As a rule of thumb in designing the restrictors, the pressure loss intended to be achieved is 0.1 MPa or higher. On the other hand, to inhibit that any excessive pressure loss strains any member, designing to achieve 30 MPa or lower is preferred. The pressure loss is decided by the flow amount of the polymer per each metering hole and the viscosity of the polymer. For example, a polymer with a viscosity of 100 to 200 Pa·s at a temperature of 280° C. and at a strain rate of 1000 $s^{-1}$ is used for melt spinning at a spinning temperature of 280 to 290° C. with a discharge rate of 0.1 to 5 g/min per metering hole, it is preferred that the restrictor of each metering hole has a hole diameter of 0.01 to 1.0 mm and an L/D (hole length/hole diameter) ratio of 0.1 to 5.0. In these ranges, discharge with good metering capability can be performed. In the case where the melt viscosity of a polymer is smaller than the above-mentioned viscosity range or in the case where the discharge rate of each hole declines, it is only required to reduce the hole diameter close to the lower limit of the above-mentioned range and/or to elongate the hole length close to the upper limit of the above-mentioned range. On the contrary, in the case where the viscosity is high or the discharge rate increases, the operations reverse to the above can be performed for the hole diameter and the hole length. Further, it is preferred to laminate multiple constituent metering plates, each as described above, and to meter the polymer amount stepwise. Preferred is a configuration wherein 2 to 10 metering plates having the aforementioned restrictors (metering holes) formed are laminated.

The polymers discharged from the respective metering holes (9) (9-(*a*) and 9-(*b*)) flow into the distribution grooves (10) of the distribution plate (7). In this case, it is preferred that between the metering plate (6) and the distribution plate (7), grooves as many as the metering holes (9) are arranged, and that passages in which the lengths of the grooves gradually extend downstream in the cross sectional direction are provided to extend the polymer (A) and the polymer (B) in the cross sectional direction before they flow into the distribution plate, in the light of enhancing the stability of the sea-island composite cross section. Also in this case, it is more preferred to form metering holes in the respective passages as described before.

A composite spinneret in which at least two members constituting the upstream configuration of the discharge plate for discharging the composite polymer stream consisting of joined polymers is provided. Each of the at least two members has multiple grooves for temporarily storing the respective component polymers; multiple holes are formed in each of the grooves in the cross sectional direction of the groove; and other multiple grooves for joining the polymers coming from the multiple independent grooves and for temporarily storing them are formed on the downstream side of the multiple holes in each of the members. Specifically in the distribution plate, distribution grooves 10 (10-i a) and 10-(*b*)) for joining the polymers flowing from the metering holes (9) are formed and distribution holes 11 (11-(*a*) and 11-(*b*)) for feeding the polymers downstream are formed in the bottom surfaces of the distribution grooves. From the viewpoint of decreasing the number of constituent plates laminated as the distribution plate, it is preferred that the number of distribution grooves is at least two or more per one discharge hole at the most upstream portion of the distribution plate. On the other hand, to increase the number of island component fibers in the sea-island composite fiber, it is preferred to increase the number of distribution grooves stepwise toward the final constituent plate of the distribution plate. Design is easy if reference is made to the numbers of the distribution holes of the respective components formed in the constituent distribution plate immediately above.

From the viewpoint of increasing the number of island component fibers, it is preferred that each distribution groove (10) is provided with 2 or more multiple distribution holes.

Further, it is preferred that multiple constituent distribution plates are laminated as the distribution plate (7) so that the respective polymers can repeat partial joining and distribution individually. The reason is that in the case where passages are designed to perform repetition with multiple distribution holes/a distribution groove/multiple distribution holes, even if a distribution hole is closed locally, the polymer stream can flow into other distribution holes. Consequently, even in the case where a distribution hole is closed, the deficient portion is filled in the downstream distribution groove. Further, in the case where multiple distribution holes are formed in the same distribution groove and where such arrangement is repeated, even if the polymer of a closed distribution hole flows into other holes, the influence becomes substantially none. Further, the effect of providing the distribution grooves is large in view of inhibiting the variation of viscosities, since each polymer undergoing various passages, i.e., heat histories is joined multiple times. In the case where the repetition of such distribution holes/distribution groove/distribution holes is designed, a structure in which downstream distribution grooves are arranged at an angle of 1 to 179° in the circumferential direction relatively to upstream distribution grooves, for joining the bodies of each polymer flowing from different distribution grooves is suitable since the bodies of each polymer undergoing different heat histories and the like are joined multiple times. Hence, the structure is effective for control of the sea-island composite cross section. Further, in view of the aforementioned purpose, it is preferred that the joining and distribution mechanism is employed already from a more upstream portion, and it is preferred to employ the mechanism also in the metering plate and further in the member upstream of the metering plate. Furthermore, a mechanism in which distribution/joining/distribution is repeated multiple times is preferred from the viewpoint of stability of discharge rate, and it is preferred that 2 to 15 constituent plates are laminated to constitute the distribution plate.

The composite spinneret with this structure always stabilizes the flow of the polymers as described before, and allows the production the sea-island composite fiber with a very large number of highly precise island component fibers. The number of the distribution holes (11-(*a*)) of polymer A (the number of island component fibers) that can be formed ranges from 2 to an infinite number allowed by the space. A preferred substantially practically achievable range is 2 to 10000 island component fibers. A more preferred range capable of satisfying the sea-island composite fiber reasonably is 100 to 10000 island component fibers, and the island packing density is only required to be in a range from 0.1 to 20 island component fibers/$mm^2$. From the viewpoint of the island packing density, a preferred range is 1 to 20 island component fibers/$mm^2$. The island packing density expresses the number of island component fibers per unit area, and if this value is larger, it indicates that a sea-island composite fiber with more island component fibers can be produced. The island packing density refers to here is the value obtained by dividing the number of island component fibers discharged from one discharge hole by the area of the discharge introduction hole. The island packing density can also be changed from discharge hole to discharge hole.

Figure 5:
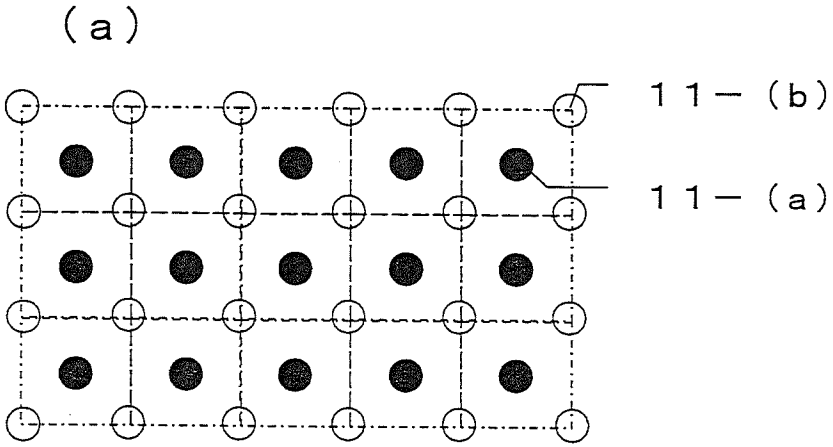
FIG. 5 show examples of the arrangement of distribution holes in the final distribution plate.
Figure 5:
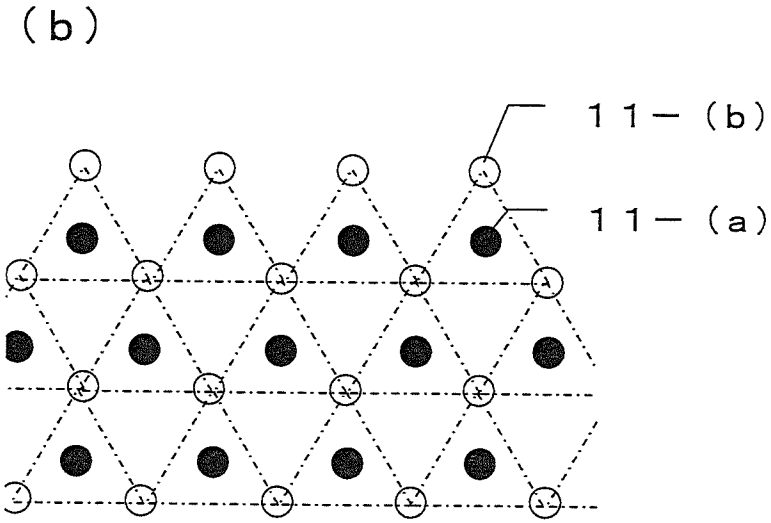
Figure 5:
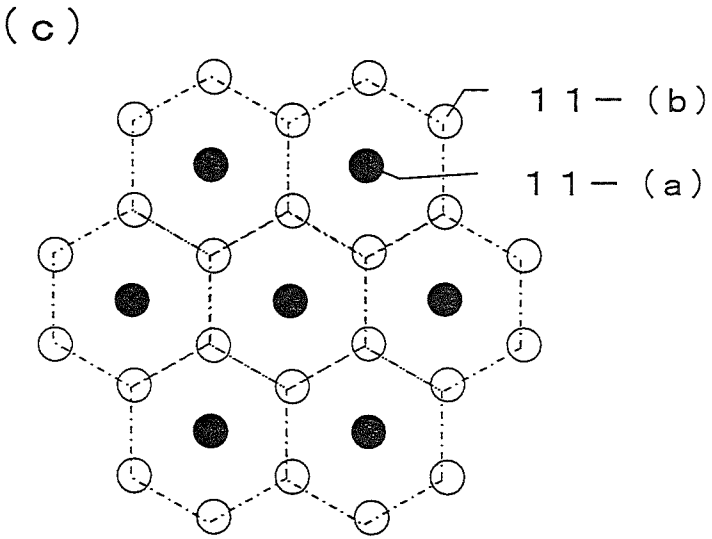

The cross sectional mode of the composite fiber and the cross sectional form of the island component fibers can be controlled by the arrangement of the distribution holes (11) of polymer (A) and polymer (B) in the constituent distribution plate (7) immediately above the discharge plate (8). Specifically so-called "staggered lattice" arrangement in which the distribution holes (11-(*a*)) of polymer (A) and the distribution holes (11-(*b*)) of polymer (B) are arranged alternately in the cross sectional direction, is preferred. Further, from the viewpoint of inhibiting the adhesion between the island component fibers, it is more preferred that the distribution holes for the sea component are formed on the circumference with the distribution hole of each island component fiber as the center. Specifically it is preferred that three or more distribution holes for the sea component are formed per one distribution hole for each island component fiber. In this range, each island component fiber can be satisfactorily surrounded, and the adhesion between the island component fibers can be inhibited. Further, in the production method, if such surrounding is used, the island component fibers can be made polygonal though it has been very difficult to produce such polygonal fibers by the prior art. For making the island component fibers polygonal, it is preferred that the number of the distribution holes for the sea component (polymer (B)) per one distribution hole for each island component fiber (polymer (A)) satisfies the following formula:

$$\frac{p}{2} - 1 \leq hs \leq 3p$$

where p is the number of vertexes of each island component (p is an integer of 3 or more), and hs is the number of distribution holes for the sea component. In the case where hs is p/2−1 or more, the polymer discharged from the distribution hole for each island component fiber can be satisfactorily surrounded. Therefore, polygonal island component fibers with sharp edges can be formed. On the other hand, the increase in the number of the distribution holes for the sea component is suitable from the viewpoint of surrounding, but the number of holes that can be formed for the island component fibers may be limited as the case may be. For this reason, it is preferred that the number of distribution holes for the sea component is 3p or less. A more preferred range of hs is p/2−1 hs 2p from the viewpoint that many distribution holes for the island component fibers can be formed. Specifically, if a design is as shown in FIG. 3, to arrange the distribution grooves of polymer (A) and polymer (B) (10-(*a*) and 10-(*b*)) alternately in the cross sectional direction and to form the distribution holes of polymer (B) between the distribution holes of polymer (A) arranged at equal intervals, then polymer (A) and polymer (B) are arranged in square lattice or triangular lattice as shown in FIGS. 5(*a*) and (*b*). Further, if two distribution grooves of polymer (B) are arranged between the distribution grooves of polymer (A) and distribution holes are formed to have polymers BBABB in the cross sectional direction (in the lengthwise direction in the drawing), then the polymers are arranged in hexagonal lattice as shown in FIG. 5(*c*). In this case, hs is 2 holes (=(⅓)×6).

Figure 6:
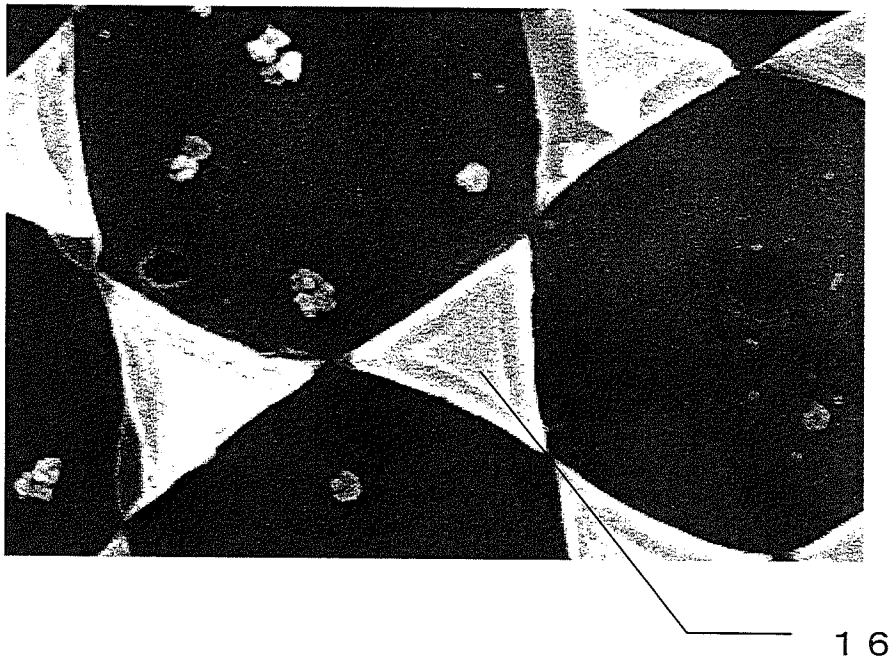
FIG. 6 shows an example of the cross section of a sea-island composite fiber (triangles in the cross section).
Figure 7:
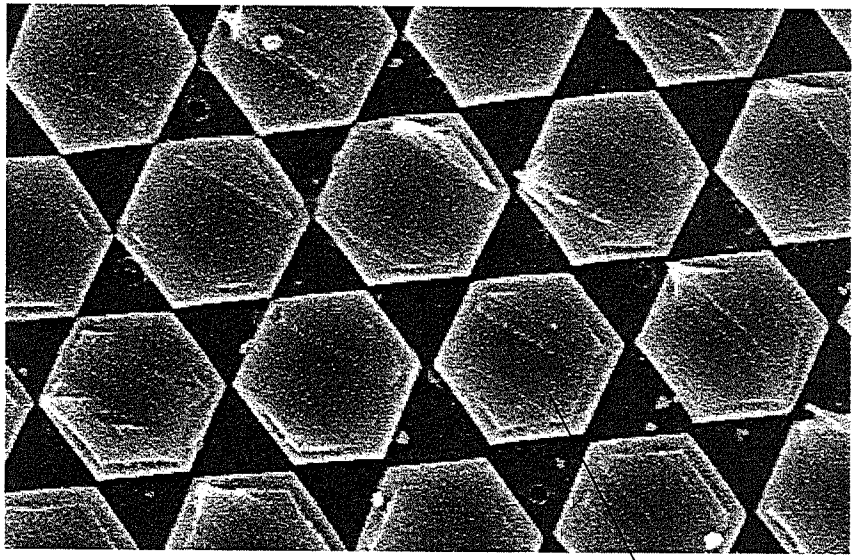
FIG. 7 shows an example of the cross section of a sea-island composite fiber (hexagons in the cross section).

Meanwhile, in this composite spinneret, it is suitable for obtaining the sea-island composite fiber that dots of both polymer (A) and polymer (B) are arranged in the sea-island composite cross section to arrange the sea component directly, although this arrangement is not performed in conventional spinnerets. The sea-island composite cross section constituted in the distribution plate is similarly compressed and discharged. In this case, if the dots are arranged as shown in any one of FIG. 5, the amounts of the polymers discharged from the respective distribution holes relatively to the amounts of the polymers of each distribution hole are the occupation rates based on the sea-island composite cross section, and the expansion ranges of polymer (A) are limited to the ranges of the dotted lines in FIG. 5. Accordingly, for example, in the case where the distribution holes are arranged as shown in FIG. 5(*a*), polymer (A) has basically square cross sections (hs is 1 hole =(¼)×4), and in the case of FIG. 5(*b*), polymer (A) has basically triangular cross sections (hs is ½ hole=(⅙)×3). In the case of FIG. 5(*c*), polymer (A) has basically hexagonal cross sections. As described above, if the distribution holes for the sea component and the distribution holes for the island component are arranged as shown in FIG. 5(*b*) and FIG. 5(*c*), then the island component fibers have triangular cross sections and hexagonal cross sections respectively having interfaces with very high edges as shown in FIGS. 6 and 7.

In addition to the regular arrangements presented as examples in the above, an arrangement in which multiple distribution holes of polymer (A) are surrounded by multiple distribution holes of polymer (B), an arrangement in which one each distribution hole with a small diameter for polymer (B) is added between the distribution holes of polymer (B), and an arrangement in which ellipses or rectangles are arranged locally in addition to circles as the distribution holes of polymer (B), can be suitable means from the viewpoint of producing a sea-island composite fiber having highly noncircular island component fibers.

With regard to the cross sectional form of the island component fibers, the non-circularity and the cross sectional form can be controlled in response to applications by changing the above-mentioned arrangement of distribution holes and changing the viscosity ratio of polymer (A) and polymer (B) (polymer (A)/polymer (B)) in a range from 0.5 to 10.0. Basically the arrangement of distribution holes controls the expansion ranges of the island component fibers. However, since the reducing hole (13) of the discharge plate joins and reduces the size in the cross sectional direction, the melt viscosity ratio of polymer (A) and polymer (B) at the time, i.e., the stiffness ratio in the molten state affects the formation of the cross section. Therefore, to obtain polygons with straight sides as the cross sectional form of the island component fibers, it is desirable that the polymer (A)/polymer (B) ratio is 0.5 to 1.3, and in order to obtain ellipses with a high non-circularity, a range from 3.0 to 10.0 is desirable.

The composite polymer stream composed of polymer (A) and polymer (B) discharged from the distribution plate flows through a discharge introduction hole (12) into the discharge plate (8). In this case, it is preferred that the discharge plate (8) is provided with a discharge introduction hole (12). The discharge introduction hole (12) is provided for allowing the composite polymer stream discharged from the distribution plate (7) to flow vertically to the discharge face for a certain distance. This is intended to decrease the flow velocity difference between polymer (A) and polymer (B) and to decrease the flow velocity distribution in the cross sectional direction of the composite polymer stream. To inhibit the flow velocity distribution, it is preferred to control the flow velocities per se of the polymers by adjusting the discharge rates of the distribution holes (11) (11-(*a*) and (11-(*b*)), hole diameters and the numbers of the holes. However, if this is taken into consideration when the spinneret is designed, the number of island component fibers and the like may be limited as the case may be. Accordingly, it is preferred to design a discharge introduction hole corresponding to a period of $10^{-1}$ to 10 seconds (=Length of the discharge introduction hole/Flow velocity of the polymers) for the composite polymer stream to reach the reducing hole (13) from the viewpoint of almost perfectly making the flow velocity ratio negligible, though it is necessary to take the molecular weights of the polymers into consideration. If the discharge introduction hole is provided for this range, the distribution of flow velocities can be sufficiently eased to exhibit an effect of enhancing the stability of the cross section.

Next, the composite polymer stream is reduced in size in the cross sectional direction with the progression of the polymer stream by the reducing hole (13) before the composite polymer stream is introduced into the discharge hole with a desired diameter. In this case, the streamline in the central layer of the composite polymer stream is almost straight, but the streamline closer to the outer layer is more greatly bent. To obtain the sea-island composite fiber, it is preferred that the cross sectional mode of the composite polymer stream consisting of numerous polymer streams including those of polymer (A) or polymer (B) alone is maintained when the composite polymer stream is reduced. Consequently, it is preferred that the angle of the hole wall of the reducing hole with respect to the discharge face is set in a range from 30° and 90°.

From the viewpoint of maintaining the cross sectional mode in the reducing hole, it is preferred that multiple holes for at least one component polymer for surrounding the outermost layer of the composite polymer stream are formed in the constituent distribution plate immediately above the discharge plate of the composite spinneret. For the distribution holes, it is preferred to form the passages already from the uppermost constituent distribution plate as the passages capable of arranging at least one component polymer around the outermost layer when the entire distribution plate is designed in advance. Further, in the constituent distribution plate immediately above the discharge plate, an annular groove (15) with distribution holes formed in the bottom face thereof may also be formed as shown in FIG. 3.

The composite polymer stream discharged from the distribution plate is greatly reduced in the cross sectional direction by the reducing hole, without being mechanically controlled. In this case, the outermost layer portion of the composite polymer stream is greatly bent and, in addition, subjected to shearing with the hole wall. If the relation between the hole wall and the outer layer of the polymer stream is observed in detail, a gradient may occur in the flow velocity distribution such that the flow velocity is low owing to the shear stress at the contact face with the hole wall and that with approach to the inner layer, the flow velocity increases. This is the reason why it is preferred to form the distribution holes for discharging the sea component polymer. This is because a layer composed of the sea component polymer dissolved later is formed around the outermost layer of the composite polymer stream. That is, the above-mentioned shearing stress with the hole wall can be borne by the layer consisting of the sea component polymer, and the flow velocity distribution of the outermost layer portion becomes uniform in the circumferential direction, to stabilize the composite polymer stream. In particular, in the composite fiber produced, the uniformity in the fiber diameters and the fiber forms of the island component fibers is remarkably enhanced.

In the case where the annular groove (15) is provided to achieve the aforementioned configuration, it is desirable to consider the number of distribution grooves and the throughput rate of the constituent distribution plate, for the distribution holes formed in the bottom face of the annular groove (15). As a rule of thumb, one hole is formed per 3° in the circumferential direction, and it is preferred to form one hole per 1°. As the method for allowing the polymer to flow into the annular groove (15), for example, in the upstream constituent distribution plate, the distribution grooves of one component polymer are extended in the cross sectional direction, and distribution holes are formed at both the ends of each of the grooves, so that the polymer can flow into the annular groove (15) reasonably.

FIG. 3 shows a constituent distribution plate having one annular groove as an example, but two or more annular grooves may also be formed so that different polymers can also be made to flow in the respective annular grooves.

The composite polymer stream having a layer consisting of the sea component polymer formed around the outermost layer thereof like this is discharged from the discharge hole (14) into the spinning line while the cross sectional mode formed in the distribution plate is maintained by taking the introduction hole length and the angle of the reducing hole wall into consideration. The discharge hole (14) is provided for the purposes of re-metering the flow rate of the composite polymer stream, i.e., the discharge rate and controlling the draft (=spinning speed/linear discharge velocity) on the spinline. It is suitable to decide the diameter and the length of the discharge hole (14), considering the viscosities of the polymers and the discharge rate. When the sea-island composite fiber is produced, it is preferred to select the discharge hole diameter in a range from 0.1 to 2.0 mm and the discharge hole length/discharge hole diameter ratio in a range from 0.1 to 5.0.

As methods for producing the metering plate, distribution plate and discharge plate of the composite spinneret, the drilling and metal precision working methods used for conventional metal working can be applied. That is, working methods such as numerical control lathe working, machining, press working and laser working can be employed for production.

However, these working methods are restricted by the lower limit of the worked plate from the viewpoint of inhibiting the strain of workpieces. Accordingly, it is preferred that the metering plate and the distribution plate formed by laminating multiple constituent plates or some of them are produced as thin plates, from the viewpoint of applying the composite spinneret to existing equipment. In this case, an etching method commonly used for working electric/electronic parts can be suitably used.

The etching method referred to here is a method of transferring a prepared pattern to a thin plate and chemically treating the transferred portions and/or the non-transferred portions, and it is a technique for finely working a metal plate. Since this working method is not required to consider the straining of the workpiece, it is not limited by the lower limit in the thickness of the workpiece compared with the above-mentioned other working methods, and the metering holes, distribution grooves and distribution holes can be formed in a very thin metal plate.

Since the thickness of the plate prepared by etching can be made thin, even if multiple plates are laminated, the total thickness of the composite spinneret is little affected. Therefore, it is not necessary to newly prepare other pack members suitable for the distribution plates of various cross sectional modes. That is, the cross sectional mode can be changed merely by exchanging these plates, and consequently this is considered to be a preferable feature in the present time when more various higher-performance textile products are being offered. Further, etching allows production at relatively low cost. For this reason, these plates can be offered as disposable plates, and it is not necessary to confirm the clogging of distribution holes and the like. Therefore, from the viewpoint of production process control, etching is suitable. Also from the viewpoint of production process control, it is preferred that the respective plates to be laminated are pressure-bonded by diffusion bonding or the like. In this case, the number of the plates (members) to be laminated may increase in the composite spinneret compared with the conventional composite spinnerets. Therefore, from the viewpoint of preventing assembling errors when the spin pack is assembled, it is suitable to integrate the respective plates. Further, this is effective also from the viewpoint of preventing polymer leak and the like from between the plates.

The composite spinneret as described above can be used to produce the sea-island composite fiber. Meanwhile, if the composite spinneret is used, the sea-island composite fiber can be produced even by a spinning method using a solvent such as solution spinning In the case where melt spinning is selected, examples of the island component and the sea component include melt-moldable polymers such as polyethylene terephthalate, copolymers thereof, polyethylene naphthalate, polybutylene terephthalate, polytrimethylene terephthalate, polypropylene, polyolefins, polycarbonates, polyacrylates, polyamides, polylactic acid and thermoplastic polyurethane. In particular, polycondensation-based polymers typified by polyesters and polyamides are more preferred, since they are high in melting point. It is preferred that the melting point of the polymers is 165° C. or higher, since heat resistance is good. Further, the polymers may contain various additives, for example, inorganic compound such as titanium oxide, silica or barium oxide, coloring matter such as carbon black, dye or pigment, flame retarder, fluorescent whitening agent, antioxidant and ultraviolet light absorber. Further, in the case where the salt component removing treatment or island component removing treatment is supposed, the polymer can be selected from melt-moldable polymers more soluble than other polymers, such as polyesters, copolymers thereof, polylactic acid, polyamides, polystyrene, copolymers thereof, polyethylene and polyvinyl alcohol. As the soluble component, a copolyester soluble in an aqueous solvent, hot water or the like, polylactic acid, polyvinyl alcohol, or the like is preferred. In particular, it is preferred to use a polyester copolymerized with polyethylene glycol and/or sodium sulfoisophthalic acid, or polylactic acid from the viewpoints of spinnability and simple dissolution in an aqueous solvent of low concentration. Further, from the viewpoints of sea component removability and the openability of the ultrafine fibers produced, a polyester copolymerized with sodium sulfoisophthalic acid alone is especially preferred.

As for the combination between the slightly soluble component and the soluble component presented as examples in the above, it is only required to select a slightly soluble component in response to the intended application and to select a soluble component spinnable at the same spinning temperature in reference to the melting point of the slightly soluble component. In this case, it is preferred to adjust the molecular weights and the like of the respective components, considering the aforementioned melt viscosity ratio, from the viewpoint of the fiber diameter and the cross sectional form of the island component fibers of the sea-island composite fiber. Further, in the case where ultrafine fibers are produced from the sea-island composite fiber, it is preferred that the dissolving rate difference between the slightly soluble component and the soluble component in the solvent used for removing the sea component is larger, from the viewpoint of maintaining the stability of the cross sectional form of the ultrafine fibers and the mechanical properties of the ultrafine fibers. It is desirable to select a combination from the aforementioned polymers with the range up to 3000 times in mind. As combinations of polymers suitable for producing ultrafine fibers from the sea-island composite fiber, in view of the relation of melting points, polyethylene terephthalate copolymerized with 1 to 10 mol% of 5-sodium sulfoisophthalic acid as a sea component and polyethylene terephthalate or polyethylene naphthalate as an island component, and polylactic acid as a sea component and nylon 6, polytrimethylene terephthalate or polybutylene terephthalate as an island component can be presented as suitable examples. In particular, from the viewpoint of forming polygonal island component fibers with high edges, among the aforementioned combinations, it is preferred to use polyethylene terephthalate, polyethylene naphthalate or nylon 6 as an island component, and in relation with the melt viscosity of the sea component, it is desirable to adjust the molecular weights for achieving a melt viscosity ratio of 0.3 to 1.3.

The spinning temperature is the temperature at which mainly the polymer with a high melting point or a high viscosity shows flowability among the two or more polymers. The temperature showing the flowability depends on the molecular weight, but the melting point of the polymer can be referred to. The temperature can be set at melting point+60° C. or lower. It is preferred that the temperature is lower than it for such reasons that the polymers are not thermally decomposed or the like in the spinning head or spin pack and that the decline of the molecular weights can be inhibited.

The throughput rate can be 0.1 g/min/discharge hole to 20 g/min/discharge hole as a range allowing stable discharge. In this case, it is preferred to consider the pressure loss in the discharge hole for allowing the stability of discharge to be secured. As the pressure loss referred to here, a value from 0.1 MPa to 40 MPa should be taken into consideration, and it is preferred to decide the discharge rate in reference to this pressure loss range on the basis of the relation among the melt viscosities of the polymers, discharge hole diameter and discharge hole length.

The ratio between the slightly soluble component and the soluble component when spinning the sea-island composite fiber can be selected in a range from 5/95 to 95/5 as the sea/island ratio in reference to the throughput rate. In the sea/island ratio, it is considered preferable to enhance the island rate, from the viewpoint of productivity of ultrafine fibers. However, from the viewpoint of long-term stability of the sea-island composite cross section, as the sea-island ratio for efficiently producing the ultrafine fibers while maintaining stability, a more preferred sea-island ratio range is 10/90 to 50/50.

The sea-island composite polymer stream discharge like this is cooled and solidified, given an spinning oil and taken up as a sea-island composite fiber by a take-up roller with a specified peripheral speed. In this connection, the take-up speed can be decided in reference to the discharge rate and the intended fiber diameter, but to stably produce the sea-island composite fiber, a range from 100 to 7000 m/min is preferred. From the viewpoint of highly orienting the sea-island composite fiber for enhancing the mechanical properties, the sea-island composite fiber once wound can be drawn or without being once wound, the sea-island composite fiber can also be drawn in succession.

As the drawing condition, for example, a drawing machine comprising one or more pairs of rollers is used to stretch the fiber reasonably in the fiber axis direction at a peripheral speed ratio between the first roller set at a temperature higher than the glass transition temperature and lower than the melting point and the second roller corresponding to the crystallization temperature if the fiber is composed of generally melt-spinnable thermoplastic polymers, and the drawn fiber is heat-set and wound. Further, in the case of polymers not showing glass transition, the dynamic viscoelasticity of the composite fiber is measured (tan δ), and the temperature higher than the peak temperature on the high temperature side of the obtained tans can be selected as the preliminary heating temperature. In this case, from the viewpoint of enhancing the draw ratio for enhancing the mechanical physical properties, performing the drawing in multiple steps is also a suitable means.

To obtain the ultrafine fibers, the sea-island composite fiber is immersed in a solvent capable of dissolving the soluble component to remove the soluble component, thereby obtaining ultrafine fibers composed of a slightly soluble component. In the case where the soluble component is a copolymerized PET copolymerized with 5-sodium sulfoisophthalic acid or the like or polylactic acid (PLA) or the like, an alkaline aqueous solution such as sodium hydroxide aqueous solution can be used. As the method for treating the composite fiber by an alkaline aqueous solution, for example, the composite fiber or a fiber structure composed of it can be immersed in an alkaline aqueous solution. In this case, it is preferred to heat the alkaline aqueous solution to higher than 50° C. since the progress of hydrolysis can be expedited. Further, it is preferred from the industrial point of view to use a fluid dyeing machine or the like for treatment, since a large amount can be treated at a time to assure high productivity.

As described above, the method for producing the ultrafine fibers has been explained based on a general melt spinning method, but the ultrafine fibers can also be produced by a melt blow method or a spun bond method, needless to say. Further, a wet or dry solution spinning method or the like can also be used to produce the ultrafine fibers.

EXAMPLES

The ultrafine fibers are explained below specifically in reference to examples. The evaluation in the Examples and Comparative Examples was performed according to the following methods.

A. Melt Viscosity of Polymer

A polymer as chips was dried to a water content of 200 ppm or less by a vacuum drying machine, and the melt viscosity was measured using Capillograph 1B produced by Toyo Seiki Seisaku-sho, Ltd., while stepwise changing the strain rate. Meanwhile the measuring temperature was the same as the spinning temperature, and each Example or Comparative Example states the melt viscosity at 1216 $s^{-1}$. Measurement was started at 5 minutes after placing a sample into a heating furnace, and measurement was performed in a nitrogen atmosphere.

B. Fineness of Sea-Island Composite Fibers and Ultrafine Fibers

In the case of a sea-island composite fiber, the weight per 100 m was measured. In the case of an ultrafine fiber, the weight of 1 m was measured, and the weight per 10000 m was calculated from the value. In either case, the same operation was repeated 10 times, and the simple average was calculated. In the calculated value, a fraction of 0.05 or over was counted as 0.1 and the rest was cut away, to obtain the fineness.

C. Mechanical Properties of Sea-Island Composite Fibers and Ultrafine Fibers

The stress-strain curve of a sea-island composite fiber was measured using tensile tester Tensilon UCT-100 produced by Orientec Co., Ltd. with a sample length of 20 cm at a stress rate of 100%/min. The load at break was read and divided by the initial fineness, to calculate the tensile strength. The strain at break was read and divided by the sample length, and the quotient was multiplied by 100, to calculate the breaking elongation. To obtain each of the values, the operation was repeated five times, and the simple average of the obtained results was calculated. In the calculated value, a fraction of 0.05 or over was counted as 0.1 and the rest was cut away.

D. Circumscribed Circle Diameters and Circumscribed Circle Diameter Variations (CV %) of Island Component Fibers and Ultrafine Fibers A sea-island composite fiber or ultrafine fibers were embedded in an epoxy resin, and the embedded sample was frozen by Cryosectioning System FC·4E produced by Reichert. The frozen sample was cut by Reichert-Nissei Ultracut N (ultramicrotome) equipped with a diamond knife, and the cut face was photographed at a magnification of 5000× by using H-7100FA transmission electron microscope (TEM) produced by Hitachi, Ltd. From the obtained photograph, 150 island component fibers or ultrafine fibers selected at random were sampled, and all the circumscribed circle diameters were measured from the photograph using image processing software (WINROOF). The mean value and the standard deviation were obtained. Using these results, the circumscribed circle diameter (fiber diameter) CV % was calculated from the following formula:

$$\text{Circumscribed circle diameter variation (CV \%)} = (\text{Standard deviation}/\text{Mean value}) \times 100.$$

The above-mentioned value was measured in each of the photographs of 10 places, and the mean value of 10 places was obtained. In the above, measurement was made to the first decimal place in nm, and calculation was made by counting a fraction of 0.5 or over as 1 and cutting away the rest.

To evaluate the change of the cross sectional mode with the lapse of time, spinning was performed continuously for 72 hours. The island component fibers were measured 72 hours later by the same method, to obtain the variation rate. In this case, the circumscribed circle diameter of island component fibers at the start of spinning was expressed as $D_0$, and the circumscribed circle diameter of the island component fibers of 72 hours later was expressed as $D_{72}$. A variation rate ($D_{72}/D_0$) of 1±0.1 was evaluated as ○ (no variation), and a variation rate of other than the range was evaluated as × (with variation).

E. Non-Circularity and Non-Circularity Variation (CV %) of Island Component Fibers or Ultrafine Fibers By the same method as the aforementioned method for the circumscribed circle diameter and the circumscribed circle diameter variation, the cross sections of the island component fibers were photographed, and from the image, the circumscribed circle diameter as the diameter of the complete circle circumscribing each cut face and the inscribed circle diameter as the diameter of the complete circle inscribing each cut face were measured. Then, "Non-circularity=Circumscribed circle diameter Inscribed circle diameter" was calculated to the third decimal place, and in the calculated value, a fraction of 0.005 or over was counted as 0.01 and the rest was cut away, to obtain the non-circularity. This non-circularity was measured with 150 island component fibers or ultrafine fibers sampled at random within the same image, and the non-circularity variation (CV %) was calculated using the mean value and the standard deviation of the measured values from the following formula:

$$\text{Non-circularity variation (CV \%)} = (\text{Standard deviation of non-circularity values}/\text{Mean value of non-circularity values}) \times 100\ (\%).$$

The non-circularity variation was measured in each of the photographs of 10 places, and the mean value of the 10 places was calculated. In the calculated value, a fraction of 0.05 or over was counted as 0.1 and the rest was cut away.

To evaluate the change of the cross sectional mode with the lapse of time, spinning was performed continuously for 72 hours. The island component fibers were measured 72 hours later by the same method, to obtain the variation rate. In this case, the non-circularity of the island component fibers at the start of spinning was expressed as $S_0$, and the non-circularity of the island component fibers of 72 hours later was expressed as $S_{72}$. A variation rate ($S_{72}/S_0$) of 1±0.1 was evaluated as ○ (no variation), and a variation rate of other than the range was evaluated as × (with variation).

F. Evaluation of the Cross Sectional Form of Island Component Fibers or Ultrafine Fibers By the same method as the aforementioned method for the circumscribed circle diameter and the circumscribed circle diameter variation, the cross sections of the island component fibers or ultrafine fibers were photographed, and from the image, the number of straight line segments, each having two end points, in the outlines of the cross sections was counted. The evaluation was performed with the cross sections of 150 fibers sampled at random from the image within the image. The number of straight line segments was counted for 150 island component fibers or ultrafine fibers, and the total sum was divided by the number of fibers, to calculate the number of straight line segments per fiber. In the calculated value, a fraction of 0.05 or over was counted as 0.1 and the rest was cut away.

Further, extension lines indicated by symbol 5 of FIG. 1 were drawn from the straight line segments existing on the outline of each cross section. The number of intersection points formed between every two lines respectively adjacent to each other was counted, and the angles were measured. The most acute angle among the intersection points of each island component fiber or ultrafine fiber was recorded. The total sum of the recorded angles was divided by the number of fibers, and in the calculated value, a fraction of 0.5 or over was counted as 1 and the rest was cut away, to obtain the angle at intersection points. The same operation was performed with 10 images, and the simple average of the 10 places was employed as the angle at intersections.

H. Evaluation on the Dropout of Ultrafine Fibers (Island Component Fibers) at the Time of Salt Component Removing Treatment A knitted fabric composed of the sea-island composite fibers produced under any of various spinning conditions was placed in a sea component removing bath (bath ratio 100) filled with a solvent capable of dissolving the sea component, to dissolve and remove 99% or more of the sea component.

To confirm whether or not the ultrafine fibers dropped out, the following evaluation was performed.

One hundred milliliters of the solvent used for the sea component removing treatment was sampled and an aqueous solution containing the solvent was passed through glass fiber filter paper with a residual particle size of 0.5 μm. In reference to the difference between the dry weight of the filter paper before treatment and that after treatment, whether or not the ultrafine fibers dropped out was decided. A case where the weight difference was 10 mg or more was evaluated as suffering dropout (×), and a case where the weight difference was less than 10 mg was evaluated as not suffering dropout (○).

I. Openability of Ultrafine Fibers

The sea component of a knitted fabric composed of sea-island composite fibers was removed under the above-mentioned sea component removing condition, and the cross section of the knitted fabric was photographed at a magnification of 1000× using VE7800 scanning electron microscope (SEM) produced by Keyence Corporation. Ten cross sections of the knitted fabric were photographed, and the states of the ultrafine fibers were observed on the images. A case where the ultrafine fibers existed independently from each other and were disengaged from each other was evaluated as good openability (○), and a case where the number of bundles per image was less than 5 was evaluated as rather poor openability (Δ). A case where the number of bundles per image was 5 or more was evaluated as poor openability (×).

Example 1

Polyethylene terephthalate (PET1, melt viscosity 120 Pa·s, T301T produced by Toray Industries, Inc.) as the island component and PET copolymerized with 5.0 mol % of 5-sodium sulfoisophthalic acid (copolymerized PET1, melt viscosity 140 Pa·s, A260 produced by Toray Industries, Inc.) as the sea component were respectively separately melted at 290° C., then metered and made to flow into a spin pack containing the composite spinneret shown in FIG. 2, and composite polymer streams were discharged from discharge holes. Meanwhile, 4 constituent plates were laminated as the metering plate, and passages were formed in such a manner as to expand with downstream progression. The respective constituent metering plates were provided with restriction holes (φ0.4, L/D=1.5) to stepwise meter the sea component polymer and the island component polymer. Further, 10 constituent plates were laminated as the distribution plate, and passages were formed in such a manner that fine polymer streams might be distributed in the cross sectional direction of the fibers. The constituent distribution plate immediately above the discharge plate had 1000 distribution holes formed for island component fibers, and the hole arrangement pattern was as shown in FIG. 5(*c*). The annular groove for the sea component indicated by symbol 15 of FIG. 3 had distribution holes formed every 1° in the circumferential direction. Furthermore, the length of the discharge introduction hole was 5 mm, and the angle of the reducing hole was 60°. The diameter of the discharge hole was 0.5 mm, and the length of the discharge hole/the diameter of the discharge hole was 1.5. The composite ratio of sea component/island component was 30/70. The discharged composite polymer streams were cooled and solidified, then given a spinning oil, and wound at a spinning speed of 1500 m/min, to obtain 15 as-spun fibers of 150 dtex each (total discharge rate 22.5 g/min). The wound as-spun fibers were drawn between rollers heated to 90° C. and 130° C. to 3.0 times at a drawing speed of 800 m/min. Fifteen sea-island composite fibers of 50 dtex each were obtained. Meanwhile, the drawn fibers were sampled by a drawing machine with 10 spindles for 4.5 hours, but none of the spindles encountered fiber breaking The mechanical properties of the sea-island composite fibers were 4.2 cN/dtex in tensile strength and 35% in breaking elongation.

Further, the cross sections of the sea-island composite fibers were observed, and it could be confirmed that the island component fibers had 6 straight line segments per fiber and regular hexagonal cross sections with an angle of 120° at each intersection point. The circumscribed circle diameter ($D_0$) of the island component fibers was 465 nm, and the circumscribed circle diameter variation was 5.9%. The non-circularity ($S_0$) was 1.23, and the non-circularity variation was 3.9%. The island component fibers were uniform in both diameter and form.

Subsequently, continuous spinning was performed, and the as-spun fibers sampled 72 hours later were drawn again under the above-mentioned condition. The sea-island composite fibers sampled were evaluated similarly. The circumscribed circle diameter of the island component fibers of 72 hours later ($D_{72}$) was 469 nm and the circumscribed circle diameter variation was 5.9%. The non-circularity ($S_{72}$) was 1.23 and the non-circularity variation was 4.0%. It was found that even after spinning for a long time, highly precise sea-island cross sections were maintained. The variation rate of the circumscribed circle diameter of the island component fibers ($D_{72}/D_0$) was 1.01, and the variation rate of the non-circularity ($S_{72}/S_0$) was 1.00. Both the evaluation items showed no variation (○). The results are shown in Table 1.

Examples 2 to 4

Operations were performed as described in Example 1, except that the composite ratio of sea component/island component was changed stepwise to 20/80 (Example 2), 50/50 (Example 3) and 70/30 (Example 4). The evaluation results of these sea-island composite fibers were as shown in Table 1. As found in Example 1, the island component fibers were excellent in the uniformity of the circumscribed circle diameter and form, and 72 hours later, no variation occurred either (○). The results are shown in Table 1.

was 23%. The non-circularity ($S_{72}$) was 1.08, and the non-circularity variation was 18.0%. After spinning for a long time, partially coarse island component fibers were confirmed, and it was found that the precision of the sea-island cross section greatly declined. The variation rate of the circumscribed circle diameter of island component fibers ($D_{72}/D_0$) was 1.23, and the variation rate of non-circularity ($S_{72}/S_0$) was 1.02. Both the evaluation items showed variation (×). The results are shown in Table 2.

Comparative Example 2

An operation was performed as described in Example 1, except that the sea-island composite spinneret for repeating the size reduction of passages described in JP2007-39858 was used. To make the number of island component fibers equal to that of Example 1, it was necessary to reduce the passages four times. During spinning, one time of single fiber breaking occurred, and in the drawing step, four spindles encountered fiber breaking The evaluation results of the sea-island composite fibers obtained in Comparative Example 2 were as shown in Table 2.

TABLE 1

| | | | Example 1 | Example 2 | Example 3 | Example 4 |
|---|---|---|---|---|---|---|
| Polymer | Sea | | Copolymerized PET1 | Copolymerized PET1 | Copolymerized PET1 | Copolymerized PET1 |
| | Island | | PET1 | PET1 | PET1 | PET1 |
| Sea/island ratio | Sea | % | 30 | 20 | 50 | 70 |
| | Island | % | 70 | 80 | 50 | 30 |
| Sea-island composite fiber | Tensile strength | cN/dtex | 4.2 | 4.5 | 3.9 | 3.0 |
| | Elongation | % | 35 | 35 | 29 | 29 |
| Island component fibers | Circumscribed circle diameter ($D_0$) | nm | 465 | 494 | 391 | 303 |
| | Circumscribed circle diameter variation (CV %) | % | 5.9 | 7.8 | 4.6 | 4.5 |
| | Non-circularity ($S_0$) | — | 1.23 | 1.25 | 1.21 | 1.20 |
| | Non-circularity variation (CV %) | % | 3.9 | 6.0 | 3.6 | 3.3 |
| | Straight line segments of cross section | — | 6 | 6 | 6 | 6 |
| | Number of intersection points | | 6 | 6 | 6 | 6 |
| | Angle at intersection points | ° | 120 | 120 | 120 | 120 |
| Spinning stability | Circumscribed circle diameter of 72 hours later ($D_{72}$) | nm | 469 | 497 | 391 | 299 |
| | Non-circularity of 72 hours later ($S_{72}$) | — | 1.23 | 1.25 | 1.21 | 1.19 |
| | Circumscribed circle diameter variation | — | ○ (no variation) | ○ | ○ | ○ |
| | Non-circularity variation | — | ○ (no variation) | ○ | ○ | ○ |
| Remark | | | | | | |

Comparative Example 1

The known conventional sea-island composite spinneret using pipes (1000 island component fibers) described in JP2001-192924A was used for spinning and drawing under the conditions described in Example 1. There was no problem with spinnability, but in the drawing step, two spindles encountered fiber breaking The evaluation results of the sea-island composite fibers obtained in Comparative Example 1 were as shown in Table 2. The fiber diameter was relatively small in the fiber diameter variation, but the fibers were complete circles (non-circularity 1.05). In the uniformity of the cross sectional form, the sea-island composite fibers were inferior to those of this disclosure. Meanwhile, there was no straight line segment on the cross sections of the island component fibers. The circumscribed circle diameter of the island component fibers of 72 hours later ($D_{72}$) was 583 nm, and the fiber diameter variation The circumscribed circle diameter of the island component fibers was reduced, but the island component fibers located in the outer layer portion in the cross section of the sea-island composite fiber were deformed compared with complete circles. The circumscribed circle diameter variation and the non-circularity variation were inferior to those of the sea-island composite fibers. Further, also with regard to spinning stability, variation occurred (×). No straight line segment existed on the cross sections of the island component fibers. The results are shown in Table 2.

Comparative Example 3

The copolymerized PET1 and PET1 used in Example 1 were used respectively as the sea component and the island component, and a composite spinneret containing only one metering plate having restriction holes (ϕ0.4, L/D=1.5) and a combination of 25 constituent distribution plates for distributing the sea component polymer and the island component polymer in each distribution hole to 8 holes, was used for spinning under the spinning condition described in Example 1. Meanwhile, this distribution composite spinneret was 1024 in the number of island component fibers, in which sea component fibers and island component fibers were arranged in a staggered lattice pattern. Further, the outermost circumference of the final constituent distribution plate was not provided with annularly disposed distribution holes. The composite fibers sampled greatly declined in precision as shown in Table 2 compared with the sea-island composite fibers and, further, the island component fibers had deformed elliptic forms (non-circularity 1.16). Furthermore, after continuous spinning for 72 hours, the multiple island component fibers were joined here and there in the outer layer portion, and variation occurred (×) in both the circumscribed circle diameter and the non-circularity. The results are shown in Table 2.

TABLE 2

| | | | Comparative Example 1 | Comparative Example 2 | Comparative Example 3 |
|---|---|---|---|---|---|
| Polymer | Sea | | Copolymerized PET1 | Copolymerized PET1 | Copolymerized PET1 |
| | Island | | PET1 | PET1 | PET1 |
| Sea/island ratio | Sea | % | 30 | 30 | 30 |
| | Island | % | 70 | 70 | 70 |
| Sea-island composite fiber | Tensile strength | cN/dtex | 2.9 | 2.8 | 2.8 |
| | Breaking elongation | % | 24 | 25 | 25 |
| Island component fibers | Circumscribed circle diameter ($D_0$) | nm | 471 | 482 | 476 |
| | Circumscribed circle diameter variation (CV %) | % | 12.0 | 23.0 | 19.0 |
| | Non-circularity ($S_0$) | — | 1.05 | 1.15 | 1.02 |
| | Non-circularity variation (CV %) | % | 15.0 | 16.0 | 24.0 |
| | Straight line segments of cross section | — | — | — | — |
| | Number of intersection points | | — | — | — |
| | Angle at intersection points | ° | — | — | — |
| Spinning stability | Circumscribed circle diameter of 72 hours later ($D_{72}$) | nm | 583 | 618 | 650 |
| | Non-circularity of 72 hours later ($S_{72}$) | — | 1.06 | 1.19 | 1.15 |
| | Circumscribed circle diameter variation | — | x (with variation) | x | x |
| | Non-circularity variation | — | ○ | x | x |
| Remark | | | Fiber breaking occurred during stretching | Fiber breaking occurred during stretching | |

Example 5

An operation was performed as described in Example 1, except that polyethylene terephthalate (PET2, melt viscosity 110 Pa·s, T900F produced by Toray Industries, Inc.) was used as the island component, that PET copolymerized with 8.0 mol % of 5-sodium sulfoisophthalic acid (copolymerized PET2, melt viscosity 110 Pa·s) was used as the sea component, and that the draw ratio was 4.0 times. Since the sea-island composite fibers allowed drawing at a high ratio, the strength could be relatively enhanced. The other evaluation results were as shown in Table 3, and the island component fibers were excellent in the uniformity of the circumscribed circle diameter and the form as found in Example 1. Meanwhile, the method for producing the copolymerized PET2 used as the sea component in Example 5 was as follows.

Eight point seven kilograms of dimethylterephthalic acid, 1.2 kg of dimethyl-5-sodium sulfoisophthalate (corresponding to 8 mol % based on the amount of all the acid components of the obtained polymer), 5.9 kg of ethylene glycol and 50 g of lithium acetate were added together, and ester interchange reaction was performed by heating up to 140 to 230° C. After completion of ester interchange reaction, the reaction product was transferred to a polycondensation vessel, and 30 ppm, as phosphorus atoms, of phosphoric acid, and 1 ppm, as titanium atoms based on the amount of the obtained polymer, of citric acid chelate titanium compound as a polycondensation catalyst, were added to the ester interchange reaction product. The reaction system was reduced in pressure to initiate reaction, and temperature in the reactor was gradually raised from 250° C. to 290° C., while the pressure was lowered to 40 Pa. Then, nitrogen purge was performed to return the pressure to atmospheric pressure, for stopping the polycondensation reaction, thus obtaining the copolymerized PET2.

Example 6

An operation was performed as described in Example 5, except that the total discharge rate was 90 g/min, and that the number of discharge holes of the spinneret was increased to 75 sea-island composite fibers.

The evaluation results of the sea-island composite fibers were as shown in Table 3 and, as found in Example 5, the island component fibers were excellent in the uniformity of the circumscribed circle diameter and the form.

Example 7

An operation was performed as described in Example 5, except that the spinning speed was 3000 m/min, and that the draw ratio was 2.5 times. As described before, even if the spinning and drawing speeds were enhanced, good sampling could be performed without fiber breaking The evaluation results of the obtained sea-island composite fibers were as shown in Table 3.

TABLE 3

| | | | Example 5 | Example 6 | Example 7 |
|---|---|---|---|---|---|
| Polymer | Sea | | Copolymerized PET2 | Copolymerized PET2 | Copolymerized PET2 |
| | Island | | PET2 | PET2 | PET2 |
| Sea/island ratio | Sea | % | 20 | 20 | 30 |
| | Island | % | 80 | 80 | 70 |
| Spinning and drawing condition | Total throughput rate | g/min | 22.5 | 90 | 22.5 |
| | Spinning speed | m/min | 1500 | 1500 | 3000 |
| | Draw ratio | | 4.0 | 4.0 | 2.5 |
| Sea-island composite fiber | Tensile strength | cN/dtex | 4.8 | 4.7 | 3.3 |
| | Breaking elongation | % | 23 | 24 | 43 |
| Island component fibers | Circumscribed circle diameter ($D_0$) | nm | 431 | 386 | 234 |
| | Circumscribed circle diameter variation (CV %) | % | 5.3 | 5.6 | 5.3 |
| | Non-circularity ($S_0$) | — | 1.23 | 1.25 | 1.23 |
| | Non-circularity variation (CV %) | % | 3.9 | 4.1 | 3.9 |
| | Straight line segments of cross section | — | 6 | 6 | 6 |
| | Number of intersection points | | 6 | 6 | 6 |
| | Angle at intersection points | ° | 120 | 120 | 120 |
| Spinning stability | Circumscribed circle diameter of 72 hours later ($D_{72}$) | nm | 441 | 393 | 235 |
| | Non-circularity of 72 hours later ($S_{72}$) | — | 1.23 | 1.25 | 1.20 |
| | Circumscribed circle diameter variation | — | ○ | ○ | ○ |
| | Non-circularity variation | — | ○ | ○ | ○ |
| Remark | | | | | |

Example 8

An operation was performed as described in Example 1, except that the hole arrangement pattern of the constituent distribution plate immediately above the discharge plate was as shown in FIG. 5(*b*), and that the number of island component fibers was 2000.

The cross sections of the obtained sea-island composite fibers were observed, and the island component fibers had a circumscribed circle diameter of 325 nm and had a form of regular triangle (non-circularity 2.46, three straight line segments, 60° angle at intersection point). The post processing properties were good and the openability was also excellent. The results are shown in Table 4.

Example 9

An operation was performed as described in Example 8, except that the number of island component fibers was 1000. The evaluation results of the sea-island composite fibers are shown in Table 4.

Example 10

An operation was performed as described in Example 8, except that the number of island component fibers was 450 and that the total throughput rate was 45 g/min. The evaluation results of the sea-island composite fibers are shown in Table 4.

Example 11

An operation was performed as described in Example 1, except that the hole arrangement pattern of the constituent distribution plate immediately above the discharge plate was as shown in FIG. 5(*a*).

The cross sections of the obtained sea-island composite fibers were observed, and it could be confirmed that the island component fibers had a circumscribed circle diameter of 460 nm and had a cross section of a regular square (non-circularity 1.71, four straight line segments, 90° angle at intersection point). There was no problem with post processing properties. The evaluation results are shown in Table 4.

Example 12

An operation was performed as described in Example 1, except that the hole arrangement pattern of the constituent distribution plate immediately above the discharge plate was as shown in FIG. 5(*a*), that though the number of distribution holes (1) remained to be 1000, the interval between distribution hole (1) and distribution hole (1) among every four holes lengthwise and crosswise adjacent to each other was shortened to ½ compared with that of Example 11, that the total throughput rate was set at 22.5 g/min, and that the sea/island composite ratio was set at 50/50.

The non-circularity of the island component fibers of the obtained sea-island composite fibers greatly increased to 4.85. Every four island component islands were integrated, and island component fibers with flat cross sections having 250 projected portions with sharp edges per sea-island composite fiber could be confirmed. The circumscribed circle diameter variation and the non-circularity variation showed uniformity as found in Table 4.

TABLE 4

| | | | Example 8 | Example 9 | Example 10 | Example 11 | Example 12 |
|---|---|---|---|---|---|---|---|
| Polymer | Sea | | Copolymerized PET1 | Copolymerized PET1 | Copolymerized PET1 | Copolymerized PET1 | Copolymerized PET1 |
| | Island | | PET1 | PET1 | PET1 | PET1 | PET1 |
| Sea/island ratio | Sea | % | 30 | 30 | 30 | 30 | 60 |
| | Island | % | 70 | 70 | 70 | 70 | 40 |
| Spinning and drawing condition | Number of island component fibers | | 2000 | 1000 | 450 | 1000 | 1000 |
| | Total throughput rate | g/min | 22.5 | 22.5 | 45 | 22.5 | 22.5 |
| Sea-island composite fiber | Tensile strength | cN/dtex | 4.1 | 4.3 | 4.6 | 4.0 | 3.6 |
| | Breaking elongation | % | 32 | 31 | 33 | 30 | 35 |
| Island component fibers | Circumscribed circle diameter ($D_0$) | nm | 325 | 465 | 975 | 460 | 841 |
| | Circumscribed circle diameter variation (CV %) | % | 6.1 | 5.5 | 5.0 | 5.8 | 12.0 |
| | Non-circularity ($S_0$) | — | 2.46 | 2.52 | 2.51 | 1.71 | 4.85 |
| | Non-circularity variation (CV %) | % | 4.9 | 3.0 | 3.0 | 3.0 | 5.3 |
| | Straight line segments of cross section | — | 3 | 3 | 3 | 4 | 4 |
| | Number of intersection points | | 3 | 3 | 3 | 4 | 4 |
| | Angle at intersection points | | 60 | 60 | 60 | 90 | 88 |
| Spinning stability | Circumscribed circle diameter of 72 hours later ($D_{72}$) | nm | 343 | 466 | 975 | 458 | 857 |
| | Non-circularity of 72 hours later ($S_{72}$) | — | 2.40 | 2.51 | 2.50 | 1.70 | 4.81 |
| | Circumscribed circle diameter variation | — | ○ | ○ | ○ | ○ | ○ |
| | Non-circularity variation | — | ○ | ○ | ○ | ○ | ○ |
| Remark | | | | | | | |

Example 13

An operation was performed as described in Example 9, except that nylon 6 (N6, melt viscosity 145 Pa·s, T100 produced by Toray Industries, Inc.) was used as the island component, that polylactic acid (PLA, melt viscosity 100 Pa·s, "6201D" produced by Nature Works K.K.) was used as the sea component, and that the spinning temperature was 240° C. The sea-island composite fibers obtained in Example 13 had triangular cross sections and a non-circularity of 1.20. The circumscribed circle diameter variation and the non-circularity variation of the island component fibers showed uniformity as found in Table 5.

Example 14

An operation was performed as described in Example 13, except that the copolymerized PET2 used in Example 5 was used as the sea component, that the spinning temperature was 260° C., and that the draw ratio was 4.0 times. The evaluation results of the obtained sea-island composite fibers are shown in Table 5.

Comparative Example 4

An operation was performed as described in Example 1, except that the publicly known conventional sea-island composite spinneret using pipes described in JP2001-192924A (1000 island component fibers) was used, that the nylon 6 (N6, melt viscosity 55 Pa·s) used in Example 13 was used as the sea component, that the polyethylene terephthalate (PET1, melt viscosity 135 Pa·s) used in Example 1 was used as the island component, that the spinning temperature was 285° C., and that the draw ratio was 2.3 times.

In Comparative Example 4, since the spinning temperature was too high relatively to the melting point (225° C.) of N6, the flow of the sea component in the composite stream was unstable, and many island component fibers were deformed at random in the cross sectional form while some ultrafine fibers fused together to exist as coarse fibers, though there were partially ultrafine fibers of the nano-order. Further, in the result of spinning for a long time, the partial fusion of island component fibers further progressed. The results are shown in Table 5.

Examples 15 and 16

An operation was performed as described in Example 14, except that polytrimethylene terephthalate (Example 15, 3GT, melt viscosity 180 Pa·s, "SORONA" J2241 produced by Du Pont K.K.) or polybutylene terephthalate (Example 16, PBT, melt viscosity 120 Pa·s, 1100S produced by Toray Industries, Inc.) was used as the island component, that the spinning temperature was 255° C., and that the draw ratio was as shown in Table 5. The evaluation results of the obtained sea-island composite fibers are shown in Table 5.

TABLE 5

| | | | Example 13 | Example 14 | Comparative Example 4 | Example 15 | Example 16 |
|---|---|---|---|---|---|---|---|
| Polymer | Sea | | PLA | Copolymerized PET2 | PET1 | Copolymerized PET2 | Copolymerized PET2 |
| | Island | | N6 | N6 | N6 | 3GT | PBT |
| Sea/island ratio | Sea | % | 30 | 30 | 30 | 30 | 30 |
| | Island | % | 70 | 70 | 70 | 70 | 70 |
| Spinning and drawing condition | Number of island component fibers | | 1000 | 1000 | 800 | 1000 | 1000 |
| | Spinning temperature | ° C. | 240 | 260 | 285 | 255 | 255 |
| | Draw ratio | | 2.5 | 4.0 | 2.3 | 4.0 | 4.0 |
| Sea-island composite fiber | Tensile strength | cN/dtex | 2.5 | 4.9 | 3.1 | 3.0 | 3.0 |
| | Breaking elongation | % | 43 | 30 | 25 | 34 | 28 |
| Island component fibers | Circumscribed circle diameter ($D_0$) | nm | 505 | 400 | 571 | 414 | 433 |
| | Circumscribed circle diameter variation (CV %) | % | 5.9 | 5.8 | 19.9 | 7.1 | 10.1 |
| | Non-circularity ($S_0$) | — | 2.20 | 1.21 | 1.50 | 1.20 | 1.22 |
| | Non-circularity variation (CV %) | % | 3.2 | 3.4 | 25.0 | 4.3 | 6.1 |
| | Straight line segments of cross section | — | 3 | 3 | — | 3 | 3 |
| | Number of intersection points | | 3 | 3 | — | 3 | 3 |
| | Angle at intersection points | ° | 65 | 62 | — | 66 | 62 |
| Spinning stability | Circumscribed circle diameter of 72 hours later ($D_{72}$) | nm | 525 | 400 | 853 | 416 | 452 |
| | Non-circularity of 72 hours later ($S_{72}$) | — | 2.05 | 1.21 | 1.33 | 1.20 | 1.20 |
| | Circumscribed circle diameter variation | — | ○ | ○ | x | ○ | ○ |
| | Non-circularity variation | — | ○ | ○ | x | ○ | ○ |
| Remark | | | | | | | |

Example 17

An operation was performed as described in Example 5, except that distribution plates for 200 sea-island composite fibers, having 500 distribution holes for island component fibers per one sea-island composite fiber arranged as shown in FIG. 5(*b*) were used, that the island rate was 20% (total discharge rate 22.5 g/min), that the spinning speed was 3000 m/min and that the draw ratio was 2.3 times.

The cross sections of the obtained sea-island composite fibers were observed, and very fine island component fibers with a circumscribed circle diameter of 80 nm could be obtained. In the sea-island composite fibers obtained in Example 17, the sea component fibers were very fine, but had a cross sectional form of regular triangle (non-circularity 2.25, three straight line segments, 62° angle at intersection point). The results are shown in Table 6.

Example 18

An operation was performed as described in Example 17, except that distribution plates for 150 sea-island composite fibers, having 600 distribution holes for island component fibers per one sea-island composite fiber were used, that the island rate was 50% (total throughput rate 22.5 g/min), that the spinning speed was 2000 m/min, and that the draw ratio was 2.5 times. The cross sections of the obtained sea-island composite fibers were observed, and the island component fibers had a circumscribed circle diameter of 161 nm. The results are shown in Table 6.

Example 19

In Example 19, a constituent distribution plate having the hole arrangement pattern shown in FIG. 5(*b*), and having the interval between distribution hole (1) and distribution hole (1) among every three holes adjacent to each other shortened to ⅓ compared with Example 8, with the number of distribution holes (1) kept at 1000, was used as the constituent distribution plate immediately above the discharge plate. The island component and the sea component were the PET2 and the copolymerized PET2 respectively used in Example 5. The spinning temperature and the discharge condition were as described in Example 5.

In the cross sections of the obtained sea-island composite fibers, the island component fibers regularly joined with each other, and 200 flat island component fibers were observed per one sea-island composite fiber as triangles with a circumscribed circle diameter of 990 nm connected with each other. The angle at the intersection points formed between the straight line segments of the obtained flat cross sections was measured and found to be 88°. The results are shown in Table 6.

Example 20

An operation was performed as described in Example 19, except that the sea/island ratio was 80/20 and that the draw ratio was 4.2 times.

In the obtained sea-island composite fibers, flat island component fibers with a circumscribed circle diameter of 481 nm could be observed. The results are shown in Table 6.

TABLE 6

| | | | Example 17 | Example 18 | Example 19 | Example 20 |
|---|---|---|---|---|---|---|
| Polymer | Sea | | Copolymerized PET2 | Copolymerized PET2 | Copolymerized PET2 | Copolymerized PET2 |
| | Island | | PET2 | PET2 | PET2 | PET 2 |
| Sea/island ratio | Sea | % | 80 | 50 | 20 | 80 |
| | Island | % | 20 | 50 | 80 | 20 |
| Spinning and drawing condition | Number of island component fibers | | 500 | 600 | 1000 | 1000 |
| | Spinning temperature | ° C. | 290 | 290 | 290 | 290 |
| | Draw ratio | | 2.3 | 2.5 | 4.0 | 4.2 |
| Sea-island composite fiber | Tensile strength | cN/dtex | 3.0 | 3.6 | 4.7 | 5.4 |
| | Breaking elongation | % | 44 | 39 | 31 | 25 |
| Island component fibers | Circumscribed circle diameter ($D_0$) | nm | 80 | 161 | 990 | 481 |
| | Circumscribed circle diameter variation (CV %) | % | 16.0 | 12.0 | 13.2 | 5.5 |
| | Non-circularity ($S_0$) | — | 2.25 | 2.23 | 4.78 | 4.56 |
| | Non-circularity variation (CV %) | % | 8.8 | 7.3 | 9.8 | 4.3 |
| | Straight line segments of cross section | — | 3 | 3 | 6 | 6 |
| | Number of intersection points | | 3 | 3 | 6 | 6 |
| | Angle at intersection points | ° | 62 | 62 | 88 | 89 |
| Spinning stability | Circumscribed circle diameter of 72 hours later ($D_{72}$) | nm | 79 | 159 | 991 | 480 |
| | Non-circularity of 72 hours later ($S_{72}$) | — | 2.22 | 2.20 | 1.50 | 1.20 |
| | Circumscribed circle diameter variation | — | ○ | ○ | ○ | ○ |
| | Non-circularity variation | — | ○ | ○ | ○ | ○ |
| Remark | | | | | | |

Example 21

Spinning was performed as described in Example 1, except that high molecular weight PET (PET3, melt viscosity 285 Pa·s, T704T produced by Toray Industries, Inc.) was used as the island component, that the PET copolymerized with 5.0 mol % of 5-sodium sulfoisophthalic acid (copolymerized PET3, melt viscosity 270 Pa·s) obtained by preliminarily drying the copolymerized PET1 used in Example 1 at 120° C. by a hot air drying machine and solid-phase-polymerizing in a vacuum atmosphere at 200° C. for 72 hours was used as the sea component, the spinning temperature was 300° C. and that the spinning speed was 600 m/min. The as-spun composite fibers were drawn to 4.2 times using two pairs of heating rollers heated to 90° C., 140° and 230° C., to obtain sea-island composite fibers.

The mechanical properties of the obtained sea-island composite fibers were very excellent, being 8.6 cN/dtex in tensile strength and 15% in breaking elongation. Further, in the cross sections of the sea-island composite fibers, island component fibers of a regular hexagon with a circumscribed circle diameter of 639 nm existed, and the form was very stable. The results are shown in Table 7.

Example 22

An operation was performed as described in Example 21, except that the spinning speed was 1200 m/min and that drawing was not performed. In the cross sections of the obtained sea-island composite fibers, island component fibers of a regular hexagon with a circumscribed circle diameter of 922 nm existed. The results are shown in Table 7.

TABLE 7

| | | | Example 21 | Example 22 |
|---|---|---|---|---|
| Polymer | Sea | | Copolymerized PET3 | Copolymerized PET3 |
| | Island | | PET3 | PET3 |
| Sea/island ratio | Sea | % | 30 | 30 |
| | Island | % | 70 | 70 |
| Spinning and drawing condition | Number of island component fibers | | 1000 | 1000 |
| | Spinning temperature | ° C. | 300 | 300 |
| | Draw ratio | | 4.2 | — |
| Sea-island composite fiber | Tensile strength | cN/dtex | 8.6 | 1.9 |
| | Breaking elongation | % | 15 | 484 |
| Island component fibers | Circumscribed circle diameter ($D_0$) | nm | 639 | 922 |
| | Circumscribed circle diameter variation (CV %) | % | 4.9 | 5.0 |
| | Non-circularity ($S_0$) | — | 1.24 | 1.22 |
| | Non-circularity variation (CV %) | % | 4.6 | 4.4 |
| | Straight line segments of cross section | — | 6 | 6 |
| | Number of intersection points | | 6 | 6 |
| | Angle at intersection points | ° | 120 | 120 |

TABLE 7-continued

| | | | Example 21 | Example 22 |
|---|---|---|---|---|
| Spinning stability | Circumscribed circle diameter of 72 hours later ($D_{72}$) | nm | 642 | 992 |
| | Non-circularity of 72 hours later ($S_{72}$) | — | 1.22 | 1.22 |
| | Circumscribed circle diameter variation | — | ○ | ○ |
| | Non-circularity variation | — | ○ | ○ |
| Remark | | | | |

In the sea-island composite fibers obtained by our production method as described above, the island component fibers have a very reduced fiber diameter (circumscribed circle diameter) of the nano-order, and yet have a non-circularity, being very small in the non-circularity variation. Further, even after spinning for a long time, the joining of the island component fibers, which is a problem of the prior art (Comparative Example), does not occur, and in addition, the sea-island composite cross section per se maintains high precision.

Example 23

The sea-island composite fibers produced in Example 1 were circularly knitted, and more than 99% of the sea component in the knitted fabric was removed by using 3 wt % sodium hydroxide aqueous solution (bath ratio 1:100) heated to 100° C. The dropout of ultrafine fibers at the time of sea component removal did not occur (evaluation of dropout: ○), and the openability was also good (evaluation of dropout: ○).

Then, the knitted fabric was unknitted to examine the properties of the ultrafine fibers. It was found that very uniform ultrafine fibers with a fiber diameter of the nano-order and a non-circularity were produced. The ultrafine fibers had a cross section of a regular hexagon, and the average angle at intersection points was 123°. The results are shown in Table 8.

Examples 24 and 25

Operations were performed as described in Example 23, except that the sea-island composite fibers produced in Example 2 (Example 24) or Example 4 (Example 25) were used. Post processing properties (dropout and openability of ultrafine fibers) were good. Further, the properties of the ultrafine fibers were good as found in Example 22, and the ultrafine fibers had a cross section of a regular hexagon. The results are shown in Table 8.

Comparative Example 5

An operation was performed as described in Example 23, except that the sea-island composite fibers produced in Comparative Example 1 were used as a starting material. In the post processing properties, the dropout of ultrafine fibers did not occur, but the ultrafine fibers had a cross section of a deformed circle, and the ultrafine fibers were found to be bundled in many portions (openability: ×). The results are shown in Table 9.

Comparative Example 6

An operation was performed as described in Example 23, except that the sea-island composite fibers produced in Comparative Example 2 were used as a starting material. In the post processing properties, the openability was evaluated as A, and the dropout of ultrafine fibers considered to be caused by the variation of island component fibers occurred (evaluation of dropout: ×). The results are shown in Table 9.

Comparative Example 7

An operation was performed as described in Example 23, except that the sea-island composite fibers produced in Comparative Example 3 were used as a starting material. The ultrafine fibers had a cross section of a deformed circle and the form variation was very large. In the post processing properties, the openability was evaluated as A, and the dropout of ultrafine fibers considered to be caused by the variation of island component fibers occurred (evaluation of dropout: x). The results are shown in Table 9.

Examples 26 and 27

Operations were performed as described in Example 23, except that the sea-island composite fibers produced in Example 5 (Example 26) or Example 7 (Example 27) were used as a starting material and that 1 wt % sodium hydroxide aqueous solution was used. The ultrafine fibers of Examples 26 and 27 had a hexagonal cross section, and were very good in the post processing properties. In particular, in openability, the ultrafine fibers were very disengaged from each other more excellently compared with those of Example 23 for such reasons that there were many projected portions because of hexagonal cross sections and that the influence of the residue among the ultrafine fibers was very small. The results are shown in Table 10.

Examples 28 to 30

Operations were performed as described in Example 23, except that the sea-island composite fibers produced in Example 8 (Example 28), Example 9 (Example 29) or Example 10 (Example 30) were used as a starting material. The ultrasonic fibers of all the examples had a triangular cross section, and the dropout of ultrafine fibers did not occur while the openability was good. The results are shown in Table 11.

Example 31

An operation was performed as described in Example 26, except that the sea-island composite fibers produced in Example 12 were used. The results are shown in Table 11.

Examples 32 and 33

Operations were performed as described in Example 26, except that the sea-island composite fibers produced in Example 14 (Example 32) or Example 16 (Example 33) were used. The ultrafine fibers of all the examples had a triangular cross section. Since the island component fibers had high alkali resistance, they were little affected at the time of sea component removal, and the ultrafine fibers were high in tensile strength and initial modulus. The results are shown in Table 12.

Comparative Example 8

An operation was performed as described in Example 23, except that the sea-island composite fibers produced in Comparative Example 4 were used. In Comparative Example 8, it took a long time till the sea component removing treatment was completed, and also in the post processing properties, the dropout of ultrafine fibers was outstanding. The results are shown in Table 12.

Examples 34 and 35

Operations were performed as described in Example 26, except that the sea-island composite fibers produced in Example 17 (Example 34) or Example 18 (Example 35) were used as a starting material. The results are shown in Table 13.

Example 36

An operation was performed as described in Example 22, except that the sea-island composite fibers produced in Example 21 were used as a starting material. The results are shown in Table 13.

The ultrafine fibers produced from the sea-island composite fibers were very uniform in the cross sectional form and had a non-circularity. Further, the dropout of ultrafine fibers at the time of sea component removal was little observed, and the openability was good, while the post processing properties were also excellent. Further, since the cross sectional form was highly uniform, the multifilament composed of the ultrafine fibers was high in tensile strength and initial modulus. On the other hand, in the Comparative Examples, the dropout of the ultrafine fibers at the time of sea component removal was observed frequently, and the post processing properties were inferior to those of the ultrafine fibers.

The circularly knitted fabrics of Examples 23, 26, 29, 32 and 34 and Comparative Examples 5, 7 and 8 were used to perform wiping performance tests. One milliliter of liquid paraffin mixed with talc (liquid paraffin:talc=50:50) was dropped on a slide glass, and the liquid paraffin on the slide glass was wiped off with a circularly knitted fabric of ultrafine fibers by one reciprocated stroke, and subsequently the state of the liquid paraffin was evaluated (the pressing pressure of the circularly knitted fabric was 5 g/cm$^2$). The wiped slide glass was photographed at a magnification of 50× by using a stereoscopic microscope. The result was evaluated according to the following criterion: no liquid paraffin was confirmed . . . good (○), liquid paraffin remained partially . . . passable (Δ), liquid paraffin was confirmed on the entire image plane (×).

All the examples of our ultrafine fibers exhibited good wiping performance, and were evaluated to be good (○) in wiping performance. In particular, Example 26 good in openability, Example 29 having a triangular cross section and Example 34 having a triangular cross section and a reduced fiber diameter were excellent in wiping performance, and the liquid paraffin could be wiped off perfectly even without reciprocating the fabric. On the other hand, in the Comparative Examples, even after one reciprocated stroke of wiping, the liquid paraffin was partially confirmed (Δ), or the spread of the liquid paraffin was deposited on the slide glass (×).

Further in the samples of Comparative Examples 7 and 8, the pressing pressure broke the knitted fabric, and partial dropout of ultrafine fibers occurred. The results are shown in Tables 8 to 13.

TABLE 8

| | | | Example 23 | Example 24 | Example 25 |
|---|---|---|---|---|---|
| Starting material | Sea-island composite fiber | | Example 1 | Example 2 | Example 3 |
| Ultrafine fibers | Tensile strenght | cN/dtex | 3.0 | 3.5 | 2.3 |
| | Initial modulus | cN/dtex | 32 | 41 | 24 |
| | Fiber diameter (circumscribed circle diameter) | nm | 455 | 488 | 299 |
| | Fiber diameter variation | % | 5.9 | 7.8 | 4.5 |
| | Non-circularity | — | 1.22 | 1.25 | 1.2 |
| | Non-circularity variation | % | 3.9 | 6 | 3.3 |
| | Straight line segments of cross section | — | 6 | 6 | 6 |
| | Number of intersection points | — | 6 | 6 | 6 |
| | Cross sectional form | — | Hexagon | Hexagon | Hexagon |
| Post processing properties | Dropout of ultrafine fibers | — | ○ | ○ | ○ |
| | Openability of ultrafine fibers | — | ○ | ○ | ○ |
| Wiping performance | | | ○ | — | — |
| Remark | | | | | |

TABLE 9

| | | | Comparative Example 5 | Comparative Example 6 | Comparative Example 7 |
|---|---|---|---|---|---|
| Starting material | Sea-island composite fiber | | Comparative Example 1 | Comparative Example 2 | Comparative Example 3 |
| Ultrafine fibers | Tensile strenght | cN/dtex | 2.4 | 2.3 | 2.1 |
| | Initial modulus | cN/dtex | 21 | 22 | 24 |
| | Fiber diameter (circumscribed circle diameter) | nm | 468 | 480 | 469 |
| | Fiber diameter variation | % | 12 | 23 | 20.3 |
| | Non-circularity | — | 1.05 | 1.15 | 1.02 |
| | Non-circularity variation | % | 15 | 16 | 28 |
| | Straight line segments of cross section | — | — | — | — |
| | Number of intersection points | — | — | — | — |
| | Cross sectional form | — | Circle (deformed) | Circle (deformed) | Circle (deformed) |

TABLE 9-continued

| | | | Comparative Example 5 | Comparative Example 6 | Comparative Example 7 |
|---|---|---|---|---|---|
| Post processing properties | Dropout of ultrafine fibers | — | ○ | x | x |
| | Openability of ultrafine fibers | — | x | Δ | Δ |
| Wiping performance | | | Δ | x | Δ |
| Remark | | | | Dropout of ultrafine fibers occurred at the time of wiping | Dropout of ultrafine fibers occurred at the time of wiping |

TABLE 10

| | | | Example 26 | Example 27 |
|---|---|---|---|---|
| Starting material | Sea-island composite fiber | | Example 5 | Example 7 |
| Ultrafine fibers | Tensile strenght | cN/dtex | 4.2 | 3.1 |
| | Initial modulus | cN/dtex | 29 | 35 |
| | Fiber diameter (circumscribed circle diameter) | nm | 419 | 226 |
| | Fiber diameter variation | % | 6.5 | 5.9 |
| | Non-circularity | — | 1.21 | 1.21 |
| | Non-circularity variation | % | 4.3 | 4.0 |
| | Straight line segments of cross section | — | 6 | 6 |
| | Number of intersection points | — | 6 | 6 |
| | Cross sectional form | — | Hexagon | Hexagon |
| Post processing properties | Dropout of ultrafine fibers | — | ○ | ○ |
| | Openability of ultrafine fibers | — | ○ | ○ |
| Wiping performance | | | ○ | — |
| Remark | | | Excellent wiping performance | |

TABLE 11

| | | | Example 28 | Example 29 | Example 30 | Example 31 |
|---|---|---|---|---|---|---|
| Starting material | Sea-island composite fiber | | Example 8 | Example 9 | Example 10 | Example 12 |
| Ultrafine fibers | Tensile strenght | cN/dtex | 3.2 | 3.6 | 4.0 | 3.2 |
| | Initial modulus | cN/dtex | 31 | 39 | 35 | 38 |
| | Fiber diameter (circumscribed circle diameter) | nm | 325 | 462 | 969 | 838 |
| | Fiber diameter variation | % | 6.6 | 5.5 | 5.5 | 13.0 |
| | Non-circularity | — | 2.44 | 2.50 | 2.50 | 4.82 |
| | Non-circularity variation | % | 4.3 | 3.2 | 3.3 | 5.0 |
| | Straight line segments of cross section | — | 3 | 3 | 3 | 4 |
| | Number of intersection points | — | 3 | 3 | 3 | 4 |
| | Cross sectional form | — | Triangle | Triangle | Triangle | Rectangle |
| Post processing properties | Dropout of ultrafine fibers | — | ○ | ○ | ○ | ○ |
| | Openability of ultrafine fibers | — | ○ | ○ | ○ | ○ |
| Wiping performance | | | — | ○ | — | — |
| Remark | | | | Excellent wiping performance | | |

TABLE 12

| | | | Example 31 | Example 32 | Comparative Example 8 | Example 33 |
|---|---|---|---|---|---|---|
| Starting material | Sea-island composite fiber | | Example 12 | Example 14 | Comparative Example 4 | Example 16 |
| Ultrafine fibers | Tensile strenght | cN/dtex | 3.2 | 4.8 | 0.7 | 2.1 |
| | Initial modulus | cN/dtex | 38 | 22 | 9 | 36 |
| | Fiber diameter | nm | 838 | 400 | 568 | 430 |

TABLE 12-continued

| | | | Example 31 | Example 32 | Comparative Example 8 | Example 33 |
|---|---|---|---|---|---|---|
| | (circumscribed circle diameter) | | | | | |
| | Fiber diameter variation | % | 13.0 | 5.7 | 21.3 | 10.5 |
| | Non-circularity | — | 4.82 | 1.21 | 1.49 | 1.22 |
| | Non-circularity variation | % | 5.0 | 3.4 | 26.0 | 6.1 |
| | Straight line segments of cross section | — | 4 | 3 | — | 3 |
| | Number of intersection points | — | 4 | 3 | — | 3 |
| | Cross sectional form | — | Rectangle | Triangle | Circle (deformed) | Triangle |
| Post processing properties | Dropout of ultrafine fibers | — | ○ | ○ | x | ○ |
| | Openability of ultrafine fibers | — | ○ | ○ | ○ | ○ |
| Wiping performance | | | — | ○ | x | — |
| Remark | | | | | Knitted fabric was broken, and dropout of ultrafine fibers occurred. | |

TABLE 13

| | | | Example 34 | Example 35 | Example 36 |
|---|---|---|---|---|---|
| Starting material | Sea-island composite fiber | | Example 17 | Example 18 | Example 21 |
| Ultrafine fibers | Tensile strenght | cN/dtex | 2.2 | 4.6 | 7.0 |
| | Initial modulus | cN/dtex | 43 | 38 | 58 |
| | Fiber diameter (circumscribed circle diameter) | nm | 73 | 978 | 627 |
| | Fiber diameter variation | % | 16.5 | 11.9 | 5.3 |
| | Non-circularity | — | 2.25 | 4.66 | 1.23 |
| | Non-circularity variation | % | 8.8 | 9.3 | 4.8 |
| | Straight line segments of cross section | — | 3 | 6 | 6 |
| | Number of intersection points | — | 3 | 6 | 6 |
| | Cross sectional form | — | Triangle | Flat (having projected portions) | Hexagon |
| Post processing properties | Dropout of ultrafine fibers | — | Δ | ○ | ○ |
| | Openability of ultrafine fibers | — | ○ | ○ | ○ |
| Wiping performance | | | ○ | — | ○ |
| Remark | | | Excellent wiping performance | | |

The invention claimed is:

1. Ultrafine fibers obtained by treating a sea-island composite fiber comprising island component fibers having a circumscribed circle diameter of 10 to 1000 nm, a circumscribed circle diameter variation of 1 to 20%, a non-circularity of 1.5 to 5.0, and a non-circularity variation of 1 to 10% to remove the sea component.

2. The ultrafine fibers according to claim 1, having a tensile strength of 1 to 10 cN/dtex, and an initial modulus of 10 to 150 cN/dtex.

3. The ultrafine fibers according to claim 1, wherein in the cross section in a direction perpendicular to a fiber axis of each of single fibers, an outline of fiber cross section has at least 2 or more straight line segments.

4. The ultrafine fibers according to claim 3, wherein there are 3 or more intersection points formed by the extension lines from the two straight line segments adjacent to each other.

* * * * *